US008960506B2

(12) United States Patent
Beilke et al.

(10) Patent No.: US 8,960,506 B2
(45) Date of Patent: Feb. 24, 2015

(54) CLOSURE ACCOMMODATING POURING FROM AN INVERTED CONTAINER

(75) Inventors: Stacy L. Beilke, Eagle, WI (US); John M. Wisniewski, Wauwatosa, WI (US); David VandenBerg, Brookfield, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 13/697,826

(22) PCT Filed: May 28, 2010

(86) PCT No.: PCT/US2010/036612

§ 371 (c)(1),
(2), (4) Date: Nov. 14, 2012

(87) PCT Pub. No.: WO2011/149476

PCT Pub. Date: Dec. 1, 2011

(65) Prior Publication Data

US 2013/0056501 A1 Mar. 7, 2013

(51) Int. Cl.

| | |
|---|---|
| ***B67D 3/00*** | (2006.01) |
| ***B65D 47/08*** | (2006.01) |
| ***B65D 47/32*** | (2006.01) |

(52) U.S. Cl.

CPC ..... *B65D 47/0828* (2013.01); *B65D 47/32* (2013.01); *B65D 2251/105* (2013.01)

USPC ..... 222/556; 222/481.5; 222/484; 222/547; 222/566; 222/568

(58) Field of Classification Search

USPC ..... 222/556, 546–547, 478, 481.5, 222/566–568, 482, 484, 109

See application file for complete search history.

(56) References Cited

U.S. PATENT DOCUMENTS

| | | | | | |
|---|---|---|---|---|---|
| 3,059,816 | A | * | 10/1962 | Goldstein | 222/109 |
| 3,168,221 | A | * | 2/1965 | Parker | 222/109 |
| 3,384,276 | A | * | 5/1968 | Henningfield | 222/479 |
| 3,750,915 | A | | 8/1973 | Kearney | |
| 4,241,855 | A | | 12/1980 | Yoshioka | |
| 4,452,381 | A | | 6/1984 | Freeman | |
| 4,487,342 | A | * | 12/1984 | Shy | 222/481.5 |
| 4,666,068 | A | | 5/1987 | Bush | |
| 5,141,138 | A | * | 8/1992 | Odet et al. | 222/153.07 |
| 5,147,072 | A | * | 9/1992 | Dirksing | 222/212 |

(Continued)

OTHER PUBLICATIONS

International Search Report (Form PCT/ISA/210) for PCT/US2010/036612 dated Jul. 30, 2010.

*Primary Examiner* — Frederick C Nicolas

(74) *Attorney, Agent, or Firm* — Wood, Phillips, Katz, Clark & Mortimer

(57) ABSTRACT

A closure (30) is provided for an opening (32) of a container (31) having a container interior (33) where a product may be stored. The closure (30) includes a base (34) having a deck wall (62) overlaying the opening (32), a pouring spout (64) extending along a longitudinal axis (66) from the deck wall (62) to a pouring lip (68) above the deck wall (62), a dispensing port (70) extending through the deck wall (62) and terminating at a location within the pouring spout (64) below the pouring lip (68) to direct product from the opening (32) to the pouring spout (64), and a vent port (74) spaced laterally from the dispensing port (70) and extending from a first orifice (76) in the deck wall (62) to a second orifice (78) located within the pouring spout (64) below the pouring lip (68).

14 Claims, 26 Drawing Sheets

(56) References Cited

U.S. PATENT DOCUMENTS

| | | | | |
|---|---|---|---|---|
| 5,289,950 | A * | 3/1994 | Gentile | 222/142.3 |
| 5,605,254 | A | 2/1997 | Wagner, III et al. | |
| 6,702,137 | B1 * | 3/2004 | Kowa et al. | 220/254.5 |
| 6,766,926 | B1 | 7/2004 | Elchert | |
| 6,793,104 | B2 * | 9/2004 | Kao | 222/481.5 |
| 6,926,179 | B2 | 8/2005 | Wagner, III et al. | |
| 7,328,820 | B2 * | 2/2008 | Young | 222/484 |
| 8,459,510 | B2 * | 6/2013 | Richards et al. | 222/484 |
| 8,511,492 | B2 * | 8/2013 | Webster et al. | 215/309 |
| 2007/0000955 | A1 * | 1/2007 | Barre et al. | 222/484 |
| 2009/0236373 | A1 * | 9/2009 | Laib et al. | 222/484 |
| 2010/0072231 | A1 | 3/2010 | Bloom et al. | |

* cited by examiner

FIG. 7
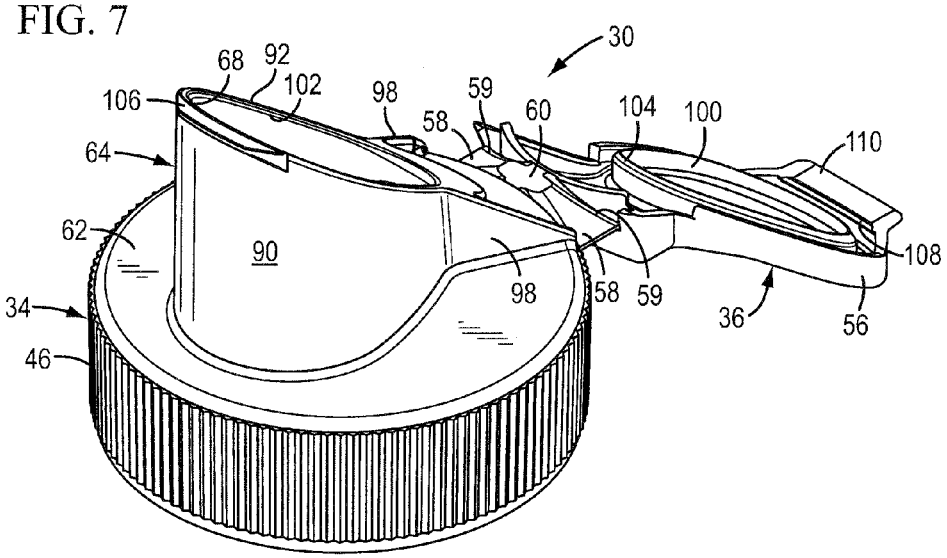
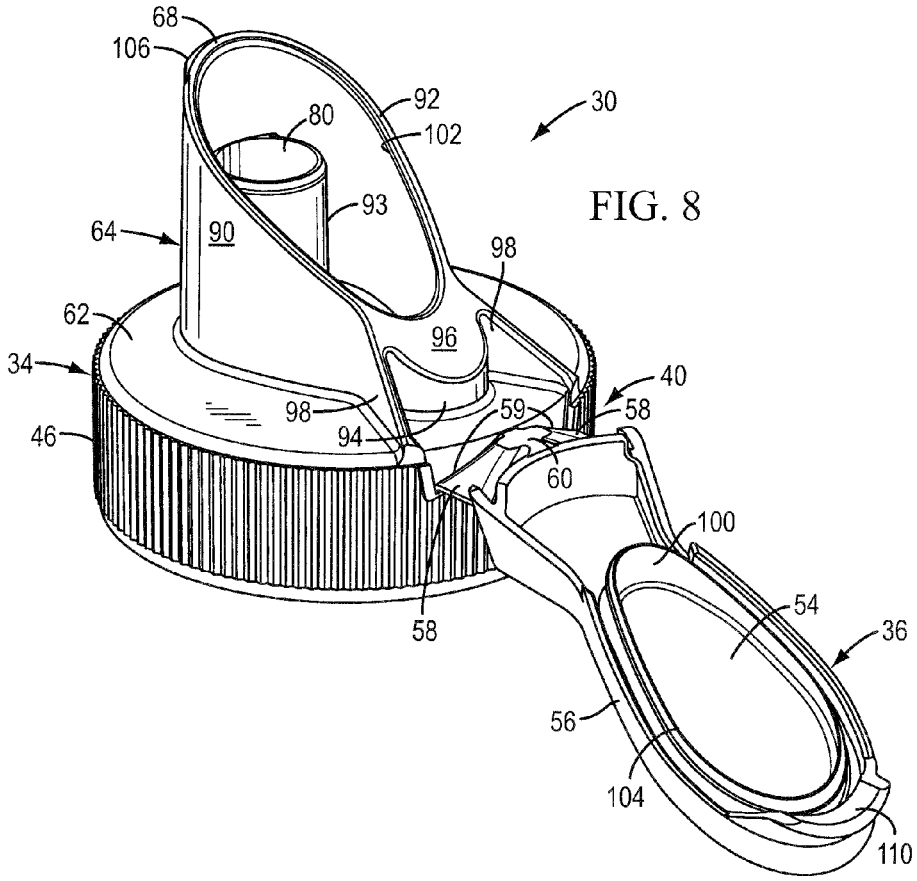
FIG. 8

CLOSURE ACCOMMODATING POURING FROM AN INVERTED CONTAINER

TECHNICAL FIELD

This invention relates to a closure for a container, and especially a closure that allows a flowable liquid to be poured from the container via the closure, and in more particular applications, to such a closure that allows a rapid pouring of the liquid from the container via the closure.

BACKGROUND OF THE INVENTION AND TECHNICAL PROBLEMS POSED BY THE PRIOR ART

Closures are typically used for facilitating the containment of, and permitting access to, a product stored in a container. There are a variety of types of conventional closures for containers. One type of prior art closure includes a body or base for being attached to the top of a container. The base defines an opening to the container interior. Such closures typically further include a lid which is hingedly mounted on the base and which can be lifted up to expose the closure base opening.

One application for such closures is in connection with containers for flowable liquids wherein the closure allows the flowable liquid to be poured from the container. One problem associated with such closures is the need for the liquid within the container to be replaced by air as the liquid is poured from the container, which can result in so-called "spurting" or "surging" of the liquid through the closure. This is particularly problematic in so-called "rapid pour" situations wherein the container is inverted or partially inverted with a very quick dispensing motion, such as might be performed by a bartender or other professional seeking a rapid dispensing of the liquid from the container. It is known to provide closures for such applications with an aeration or vent port that allows air to enter the container while liquid is poured from a dispensing port also included in the closure. Examples of such closures are shown in U.S. Pat. Nos. 4,241,855; 5,605,254; and 6,926,179. However, such closures can still suffer from "burping" wherein the liquid exits the container via the vent port, which can result in a "messy" pour where the "spurted" or "surged" liquid lands in an unintended location. While such known closures may be suitable for their intended purpose, there is always room for improvement.

The inventor of the present invention has discovered how to provide an improved closure which can accommodate designs that minimize, if not eliminate, one or more of the above-discussed problems. Further, such an improved closure can be designed to accommodate efficient, high-quality, high-speed, large volume manufacturing techniques with a reduced product reject rate to produce products having consistent operating characteristics unit-to-unit with high reliability.

BRIEF SUMMARY

According to one aspect of the present invention, an improved closure is provided for being mounted to, or formed as a unitary part of, a container that has an opening to the container interior where a product may be stored.

In accordance with one feature of the invention, a closure is provided for an opening of a container having a container interior where a product may be stored. The closure includes a base that is either (A) separate from the container for being attached to the container, or (B) a structure formed as a unitary portion of said container. The base has a deck wall overlaying the opening, a pouring spout extending along a longitudinal axis from the deck wall to a pouring lip above the deck wall, a dispensing port extending through the deck wall and terminating at a location within the pouring spout below the pouring lip to direct product from the opening to the pouring spout, and a vent port spaced laterally from the dispensing port and extending from a first orifice in the deck wall to a second orifice located within the pouring spout below the pouring lip. The second orifice oriented to direct any product exiting the second orifice along a flow vector that is non-parallel to the longitudinal axis.

As one feature, the dispensing port is defined by an orifice in the deck wall. In a further feature, the orifice terminates at the deck wall within the pouring spout.

In one feature, the dispensing port extends parallel to the longitudinal axis. According to a further feature, the dispensing port includes a surface extending above the deck wall, the surface at any point along its height having a circular cross-section. As yet a further feature, the surface has a height above the deck wall that is less than a diameter of the smallest circular cross-section. As an alternate feature, the surface has a height above the deck wall that is greater than a diameter of the smallest circular cross-section.

According to one feature, the vent port includes an orifice wall extending above the deck wall within the pouring spout, and the second orifice passes through the orifice wall. In a further feature, the vent port further includes a semi-cylindrical surface extending above the deck wall and an upper surface extending from the semi-cylindrical surface to the orifice wall to define a closed flow path between the first and second orifices.

As one feature, the closure further includes a lid connected to the base for movement between a closed position occluding the pouring spout and an open position spaced from the pouring spout. In a further feature, the pouring spout is defined by a spout wall extending above the deck wall and terminating at a peripheral edge that includes the pouring lip, and the lid includes a sealing spud sized to engage an inner surface of the peripheral edge.

In one feature, the lid is connected to the base by a snap-action type hinge that resists movement of the lid from the open position.

According to one feature, the geometries of the pouring spout, the dispensing port, and the vent port are arranged to allow the closure to be formed by a straight pull of opposing mold tools.

As one feature, the base further includes a peripheral skirt extending below the deck wall from a periphery of the deck wall.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 7 is an isometric view from above and to the left and front of the closure, with the closure shown in an open condition;

FIG. 8 is an isometric view of the open closure from above and to the left and rear;

DESCRIPTION OF THE PREFERRED EMBODIMENTS

While this invention is susceptible of embodiment in many different forms, the accompanying drawings illustrate only one specific form as an example of the invention that is presently believed to be the best mode. The specification describes the one illustrated embodiment, and also describes various alternate embodiments or variations. The invention is not intended to be limited to the embodiments so described, and the scope of the invention will be pointed out in the appended claims.

For ease of description, the illustrated embodiment of the closure that incorporates aspects of this invention is described in particular orientations, and terms such as upper, lower, horizontal, etc., are used with reference to these orientations. It will be understood, however, that the closure may be manufactured, stored, and used in orientations other than the ones described. The closure of this invention is suitable for use with a variety of conventional or special containers having various designs, the details of which, although not illustrated or described, would be apparent to those having skill in the art and an understanding of such containers. With respect to the embodiments of the invention described herein, the container, per se, forms no part of, and therefore is not intended to limit, the broadest aspects of the present invention. It will also be understood by those of ordinary skill that novel and non-obvious inventive aspects are embodied in the described exemplary closure alone.

Figure 2:
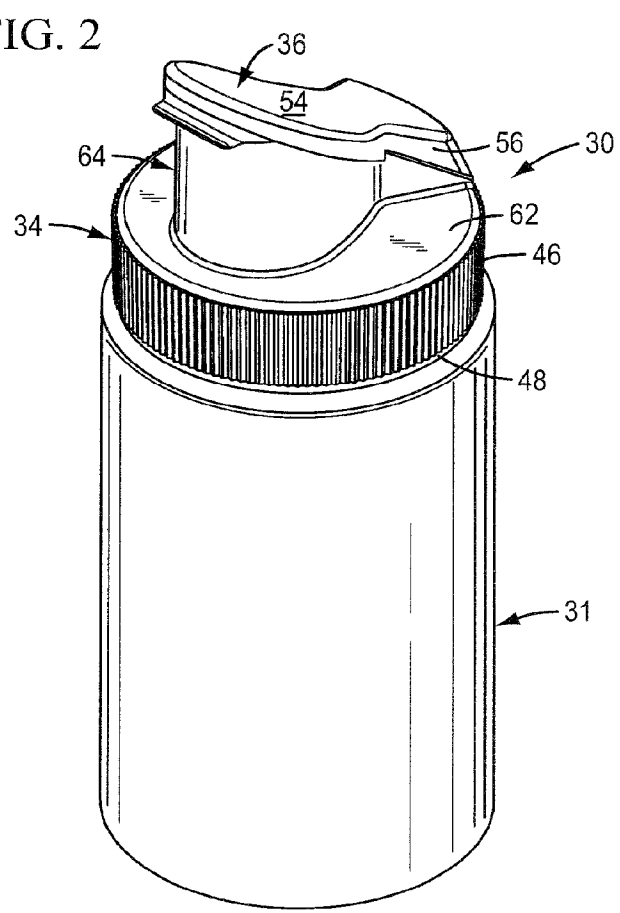
FIG. 2 is an isometric view from the front and to the left of the closure and container of FIG. 1.
Figure 1:
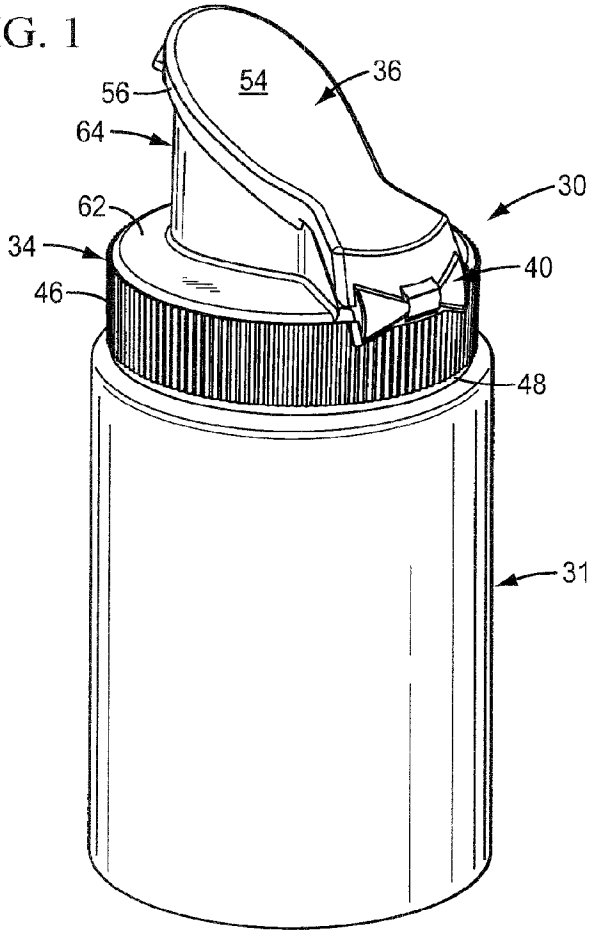
FIG. 1 is an isometric view from above and to the left and rear of the closure of the present invention in the form of a separate closure which has been installed on a container, with the closure shown in a closed condition.
Figure 3:
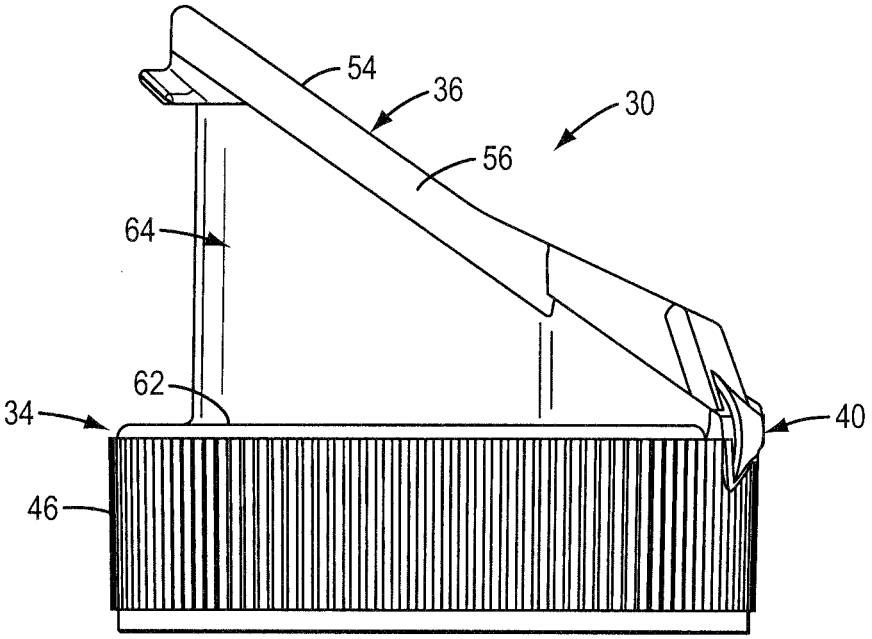
FIG. 3 is a left side elevational view of the closed closure, with the right side elevational view being a mirror image.
Figure 4:
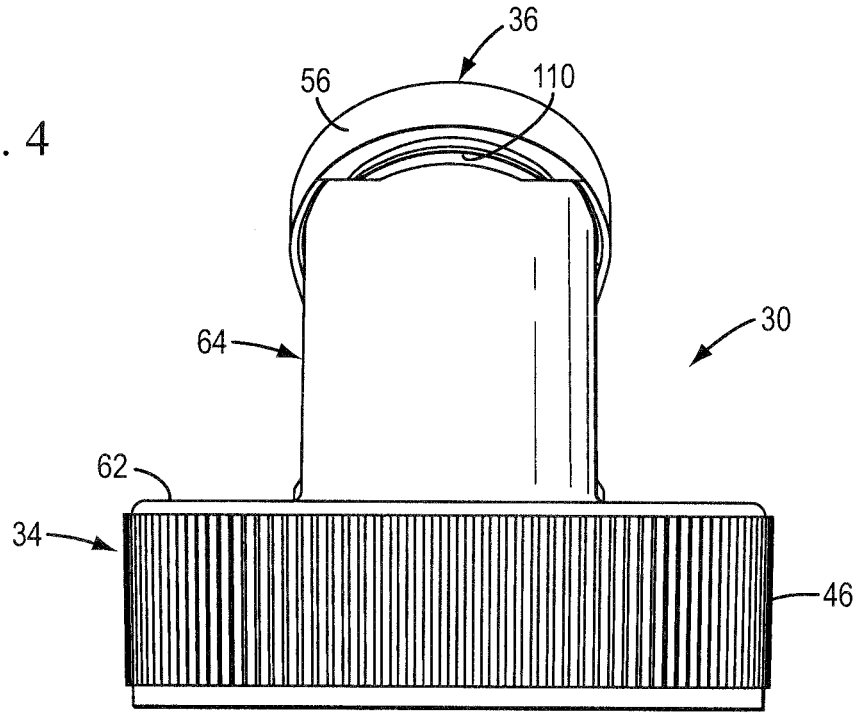
FIG. 4 is a front elevational view of the closed closure.
Figure 5:
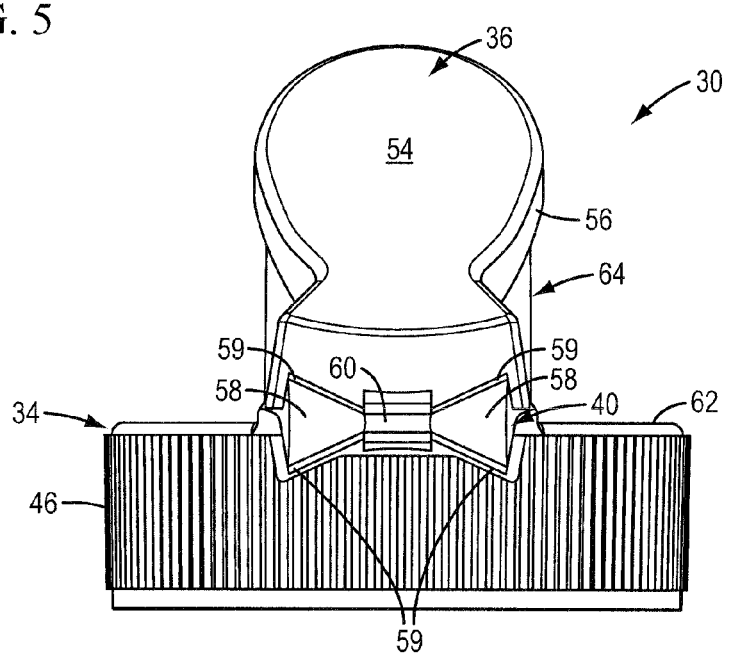
FIG. 5 is a rear elevational view of the closed closure.
Figure 6:
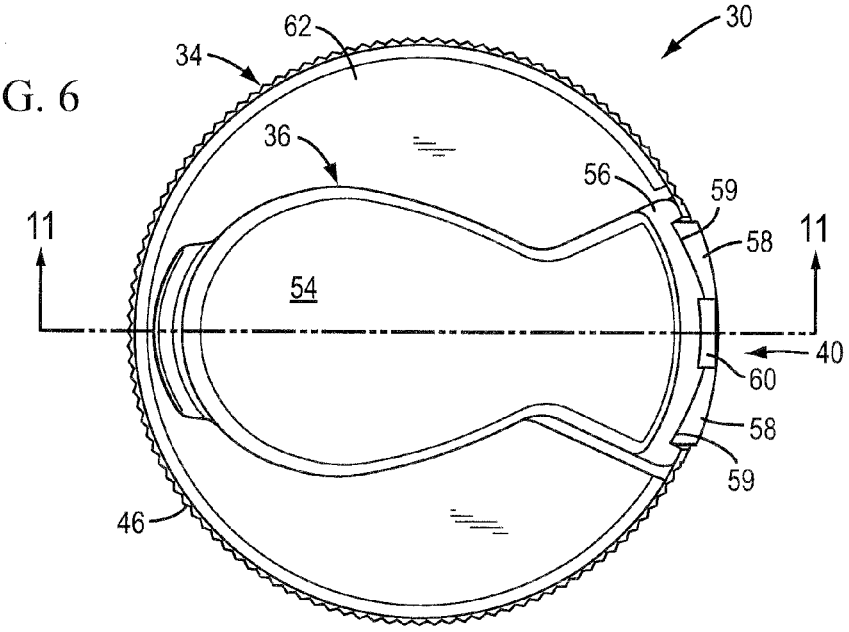
FIG. 6 is a top plan view of the closed closure.
Figure 9:
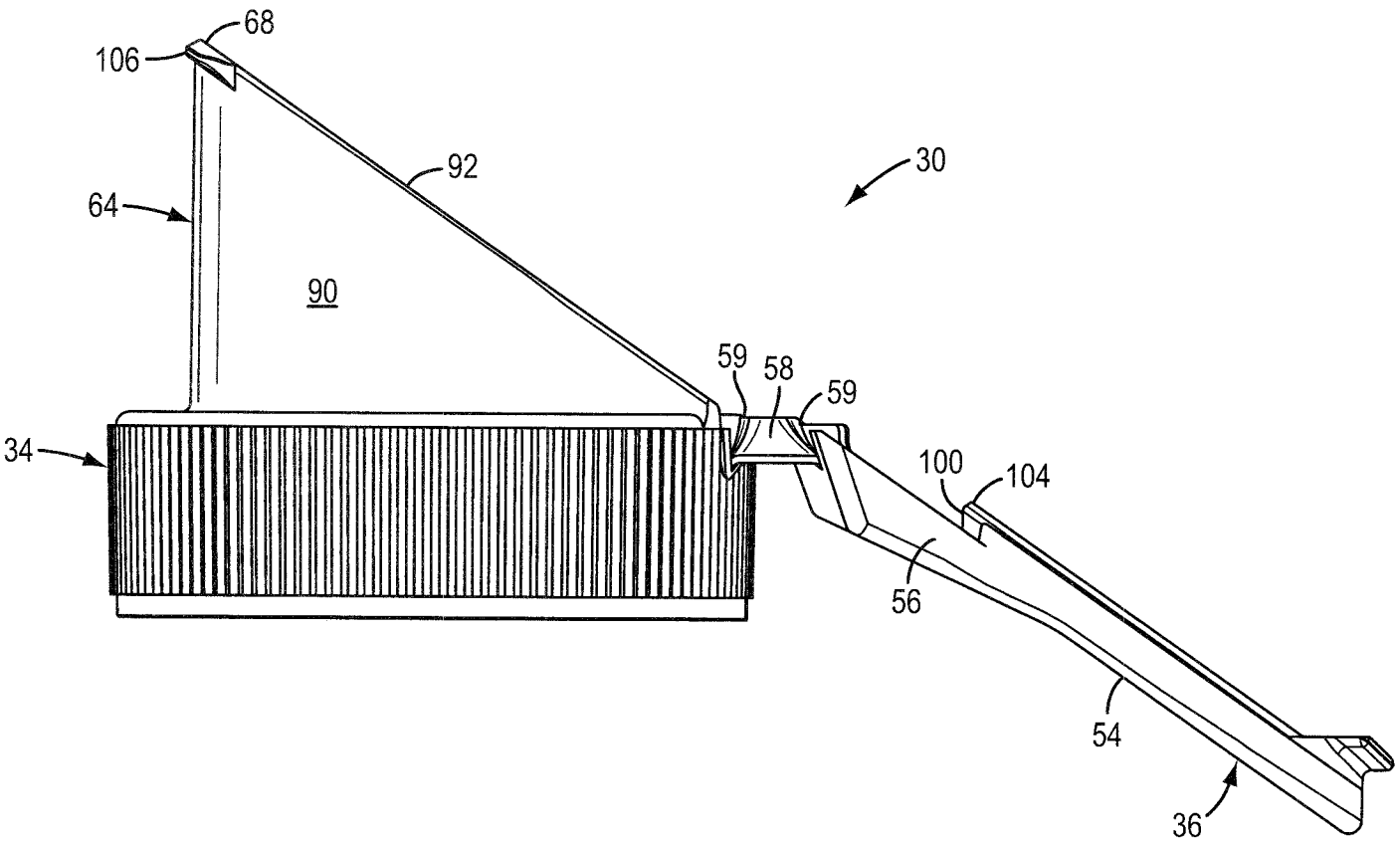
FIG. 9 is a left side elevational view of the open closure, with the right side elevational view being a mirror image.

One embodiment of a closure of the present invention is in the form of a dispensing closure illustrated in FIGS. 1-17 and is designated generally by reference number 30. In the illustrated embodiment, the dispensing closure 30 is provided as a separately manufactured article, component, or unit for being removably, or non-removably, installed (e.g., mounted) on a previously manufactured container 31 (FIGS. 1, 2 and 11) that has a mouth or opening 32 to the container interior 33 (shown in FIG. 11). It will be appreciated, however, that in some applications (not illustrated), it may be desirable for the closure 30 (or at least a base portion of the closure 30) to be formed as a unitary part, or extension, of the container wherein such a unitary part or extension defines an end structure of the container, per se.

For the closure 30 of the invention, the product will typically be a flowable liquid. However, in some applications the product may be, for example, a fluent material such as a cream, or paste-type food product or non-food product that can be poured out or squeezed out. More rare, but still possible, the product could also be pieces of material (e.g., food products such as nuts, candies, crackers, cookies, etc. or non-food products including various particles, granules, etc.), which can be removed by hand from a container, or scooped out of a container, or ladled out of a container. The product may also be a fluent material that can be poured, as well as scooped out, or ladled out, such as ground coffee, sugar, or other material, such as powders, slurries, etc. Such materials may be sold, for example, as a food product, a personal care product, an industrial product, a household product, or other types of products. Such materials may be for internal or external use by humans or animals, or for other uses (e.g., activities involving medicine, manufacturing, commercial or household maintenance, construction, agriculture, etc.).

The container 31 typically may include a neck or other suitable structure that defines the container mouth or opening 32 and that has a cross-sectional configuration with which the closure 30 is adapted to engage. The main body portion of the container 31 may have another cross-sectional configuration that differs from the cross-sectional configuration of the container neck or mouth. The container 31 may, on the other hand, have a substantially uniform shape along its entire length or height without any neck portion of reduced size or different cross-section.

The container 31 may or may not be a rigid container 31 having a generally rigid or flexible wall or walls which can be grasped by the user. However, the embodiments of the closure 30 illustrated in FIGS. 1-30 are especially suitable for use with a rigid container 31 from which the contents (e.g., the product) can be accessed through the open closure by pouring out the contents. Such a rigid container 31 is preferred in many applications but may not be necessary or preferred in other applications. For example, in some applications it may be desirable to employ a container 31 that has a substantially flexible wall that can be squeezed or deflected laterally inwardly by the user to increase the internal pressure within the container 31 so as to force the product out of the container 31 and through the opened closure 30. Such a flexible container wall typically has sufficient, inherent resiliency so that when the squeezing forces are removed, the container wall returns to its normal, unstressed shape.

The closure 30 includes a body or base 34 and a lid 36 connected to the body or base 34 with a connecting structure 40. Throughout this specification, the terms "body" and "base" will be used interchangeably. The body or base 34 includes a skirt 46 having a bottom edge 48 and a conventional, internal, female thread 50 for engaging a suitable cooperating external thread 51 (shown in phantom in FIG. 11) on the container 31, so as to secure the closure base 34 to the container 31. Alternatively, a snap-fit bead connection system (not illustrated) could be used. In another optional design (not illustrated), the closure 30 could include an internal collar configured and sized for mounting directly on, and attaching to, the container 31. The closure base 34 could also be permanently attached to the container 31 by means of induction bonding, ultrasonic bonding, gluing, or the like, depending upon the materials employed for the container 31 and closure base 34.

In the illustrated embodiment, the closure base 34, lid 36, and connecting structure 40 are molded as a unitary structure from a suitable thermoplastic material such as polypropylene or the like. Other materials may be employed instead. It should be understood that the "opened condition" shown for the closures 30 shown herein illustrates the closures 30 in their "as molded state" (the state the closures 30 are in when they are taken from the mold) which may vary slightly in use due to stress relieving of the thermoplastic material in use, particularly stress relieving of the connecting structure.

In other contemplated embodiments (not illustrated), the closure 30 need not be a structure that is completely separate from the container. Instead, the container 31 could be made with a dispensing end structure that incorporates the closure 30 as a unitary part of the container 31. In such an alternative, the illustrated closure 30 could be modified so that the closure base 34 is formed as an extension of the container 31, per se, and such an extending portion defining the closure base 34 could then be characterized as a structural feature that functions to (1) accommodate communication with the container interior, and (2) cooperate with the lid 36.

In either of the above-discussed alternatives (i.e., either a separate closure 30 or a closure having a closure base molded as an extension of a container 31), the container may have an initially open bottom end opposite the end on which the closure 30 is located, and such an initially open bottom end could be used for accommodating the filling of the container with the product (after inverting the container). After the inverted container is filled with the product through the open bottom end of the container, the open bottom end of the container could be closed by suitable means, such as by a separate bottom end closure which could be attached to the container bottom end (e.g., through a suitable threaded engagement, snap-fit engagement, adhesive engagement, thermal bonding engagement, etc.). Alternatively, such an open bottom end of the container could be deformed closed (e.g., with an appropriate process applying heat and force if the container bottom end portion is made from a thermoplastic material or other material that would accommodate the use of such a process).

Figure 11:
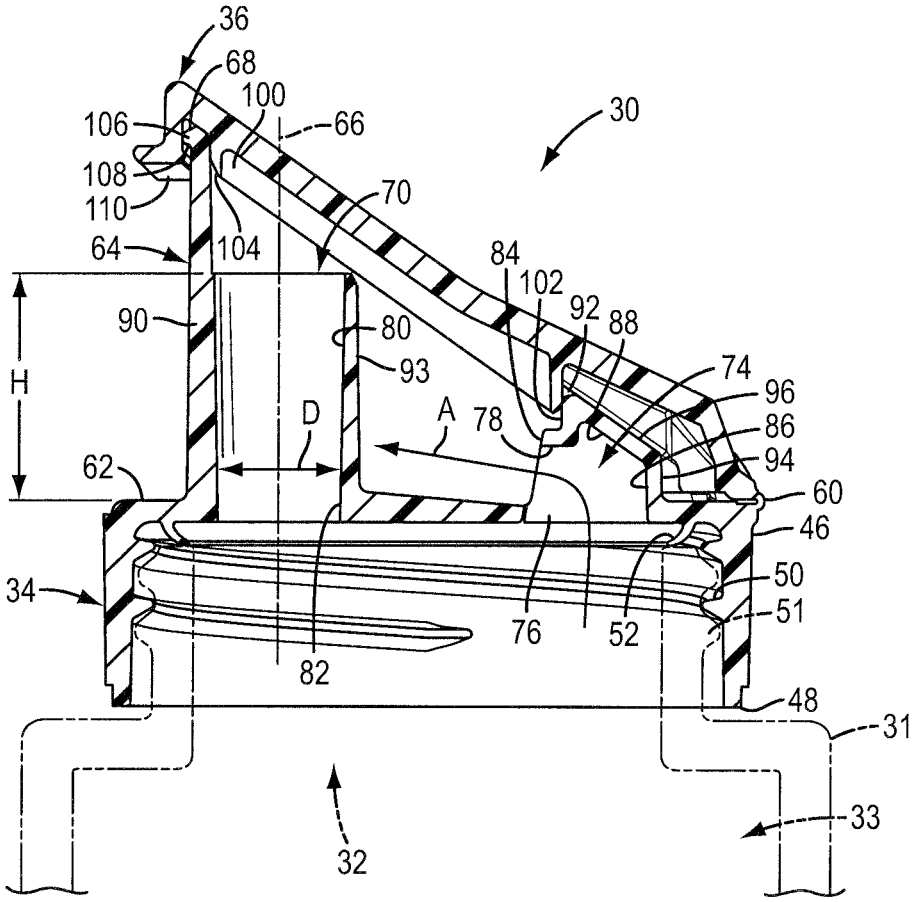
FIG. 11 is a sectional view of the closed closure taken along plane 11-11 in FIG. 6.
Figure 12:
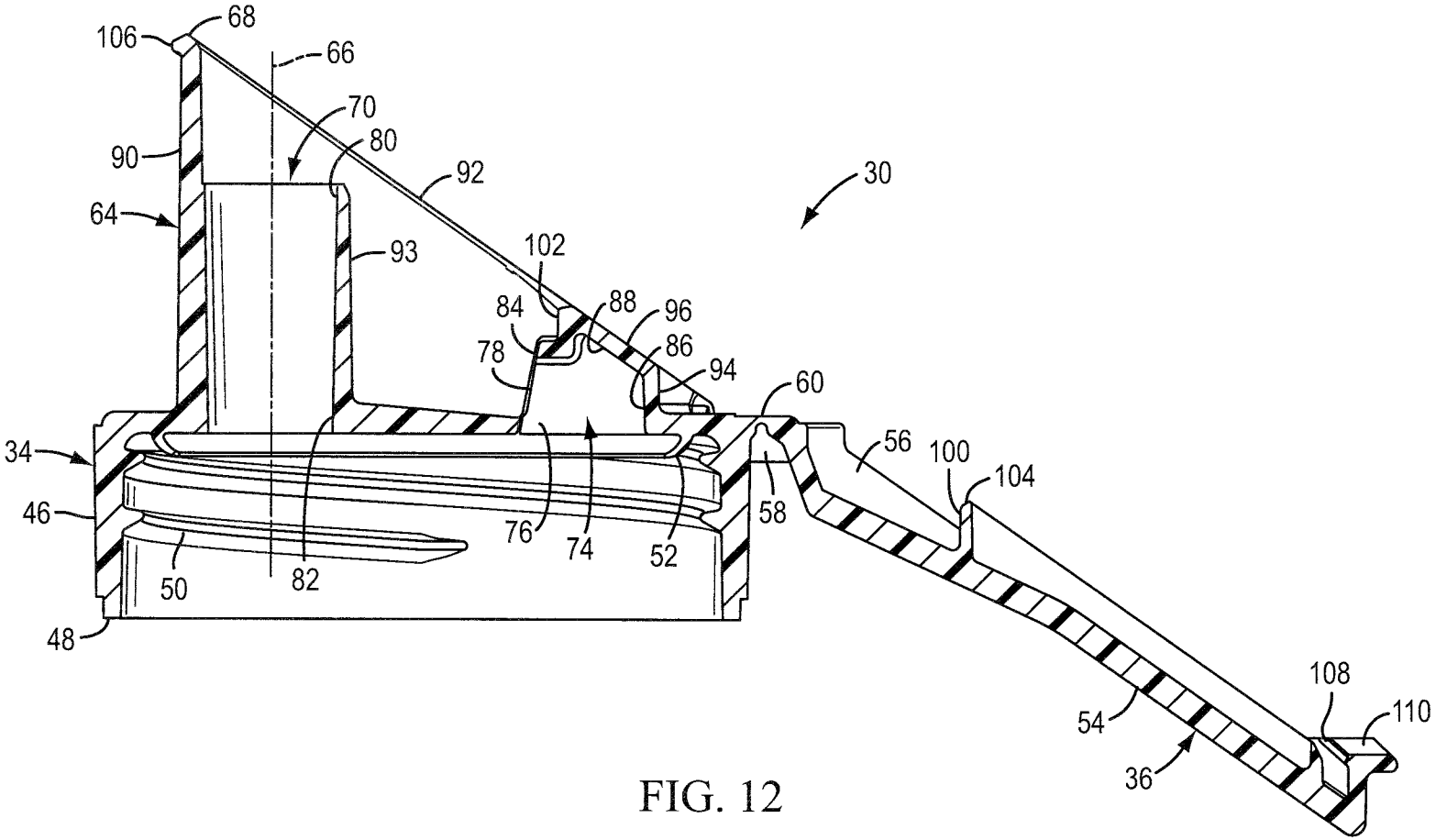
FIG. 12 is a sectional view of the open closure taken along plane 12-12 in FIG. 10.
Figure 13:
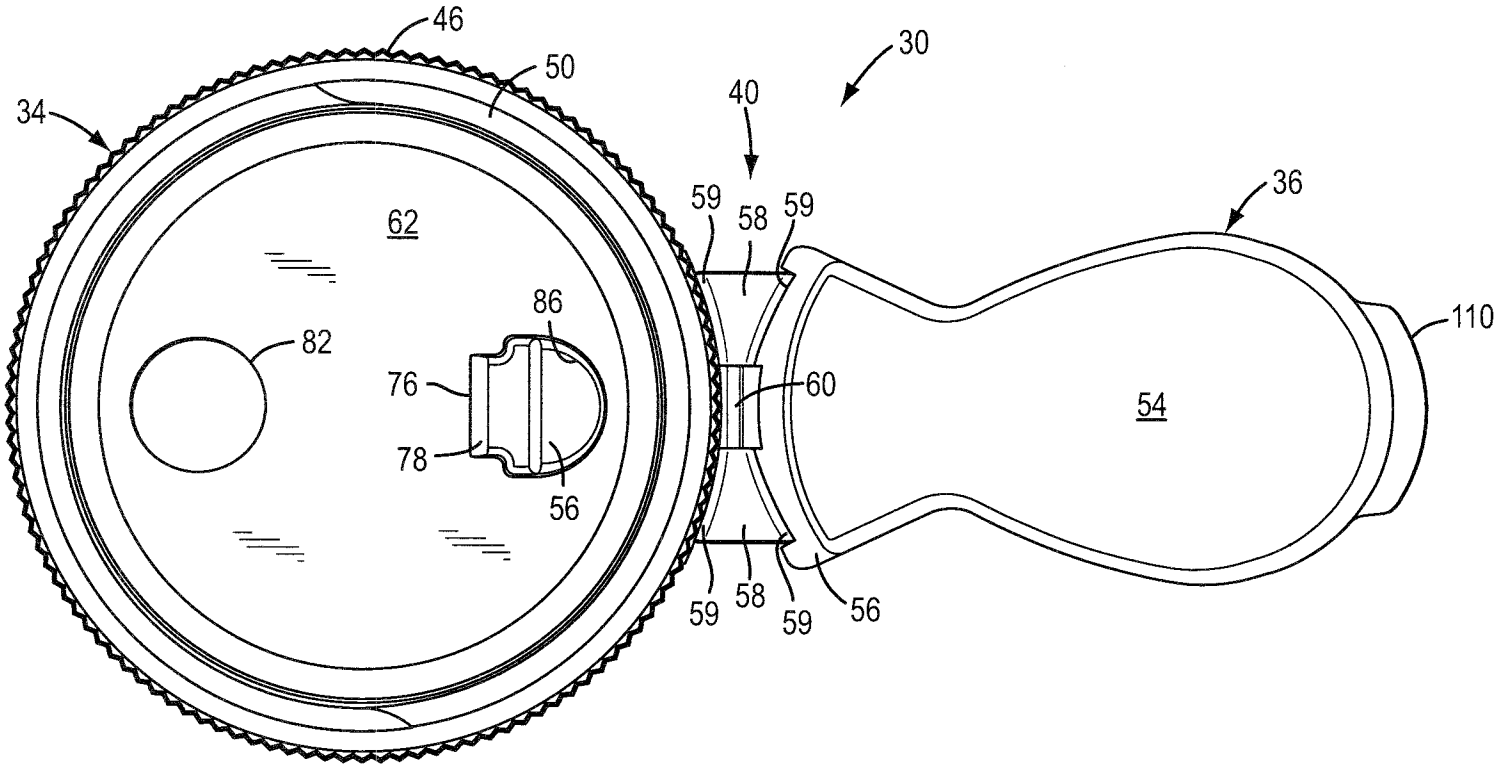
FIG. 13 is a bottom plan view of the open closure.
Figure 14:
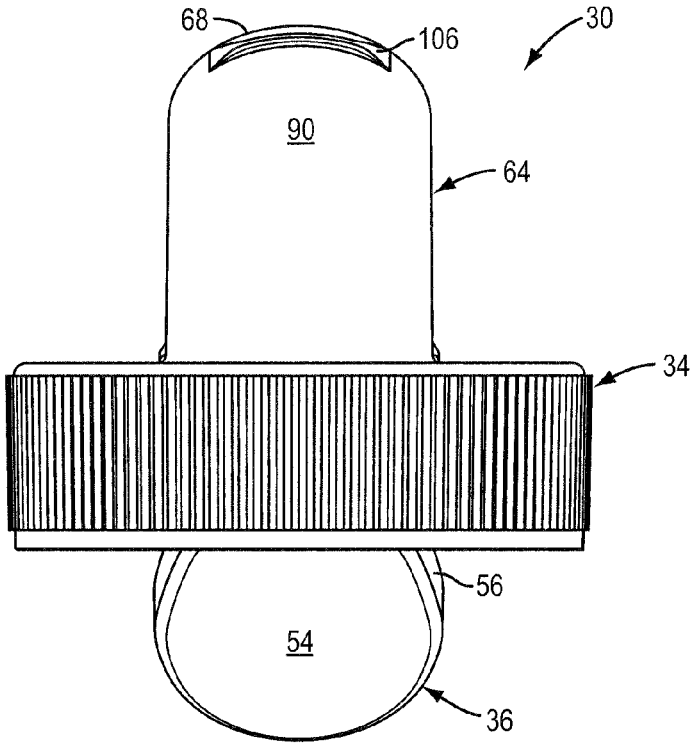
FIG. 14 is a front elevational view of the open closure.
Figure 15:
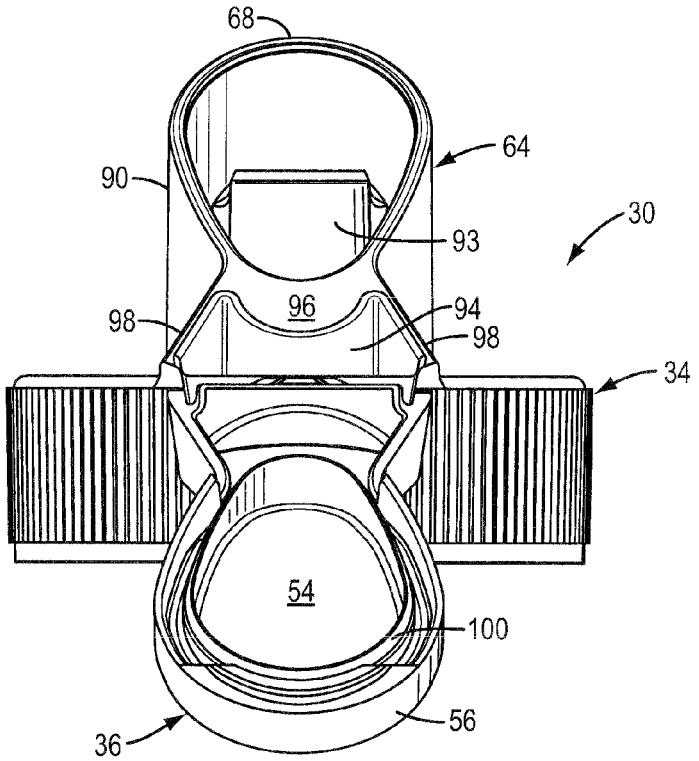
FIG. 15 is a rear elevational view of the open closure.
Figure 16:
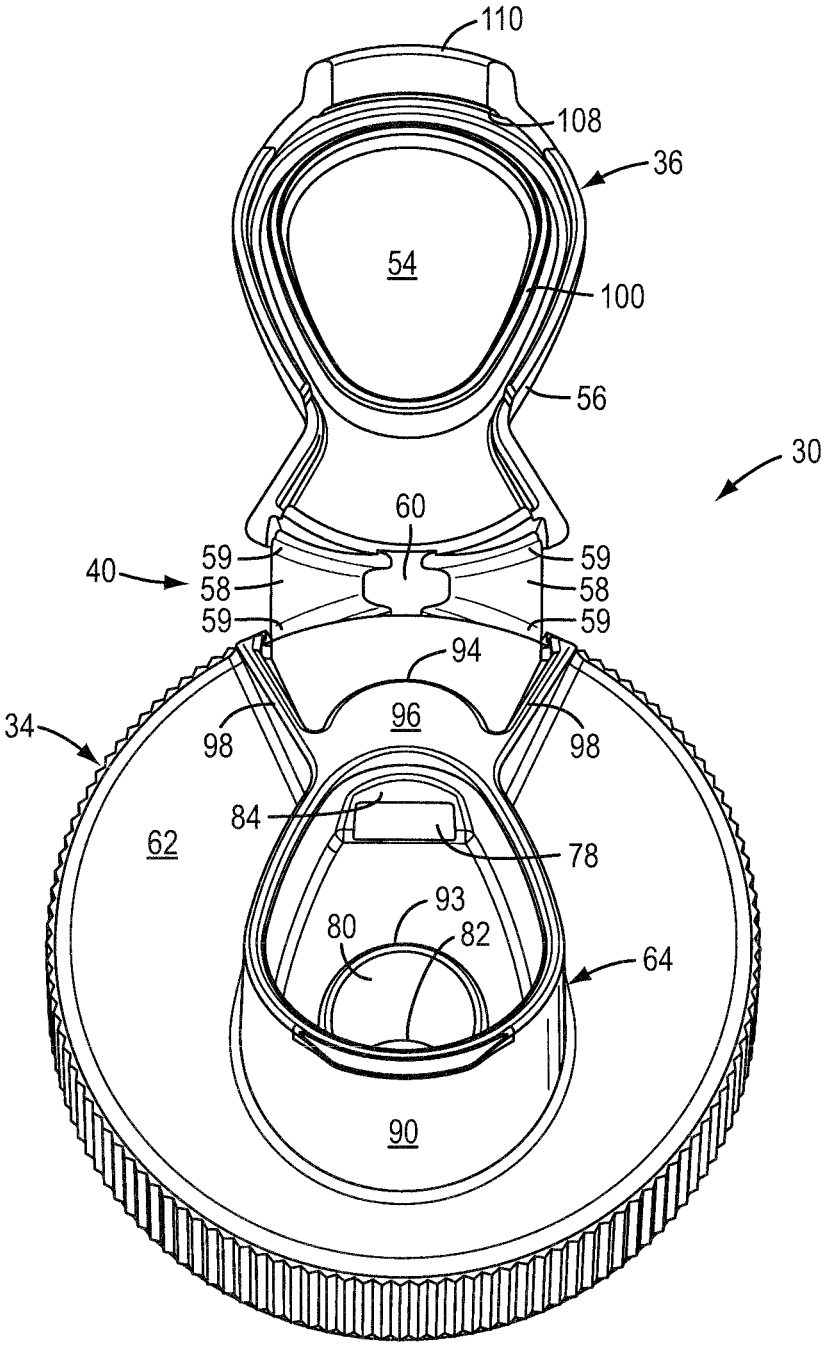
FIG. 16 is an isometric view from above and to the front of the open closure.
Figure 17:
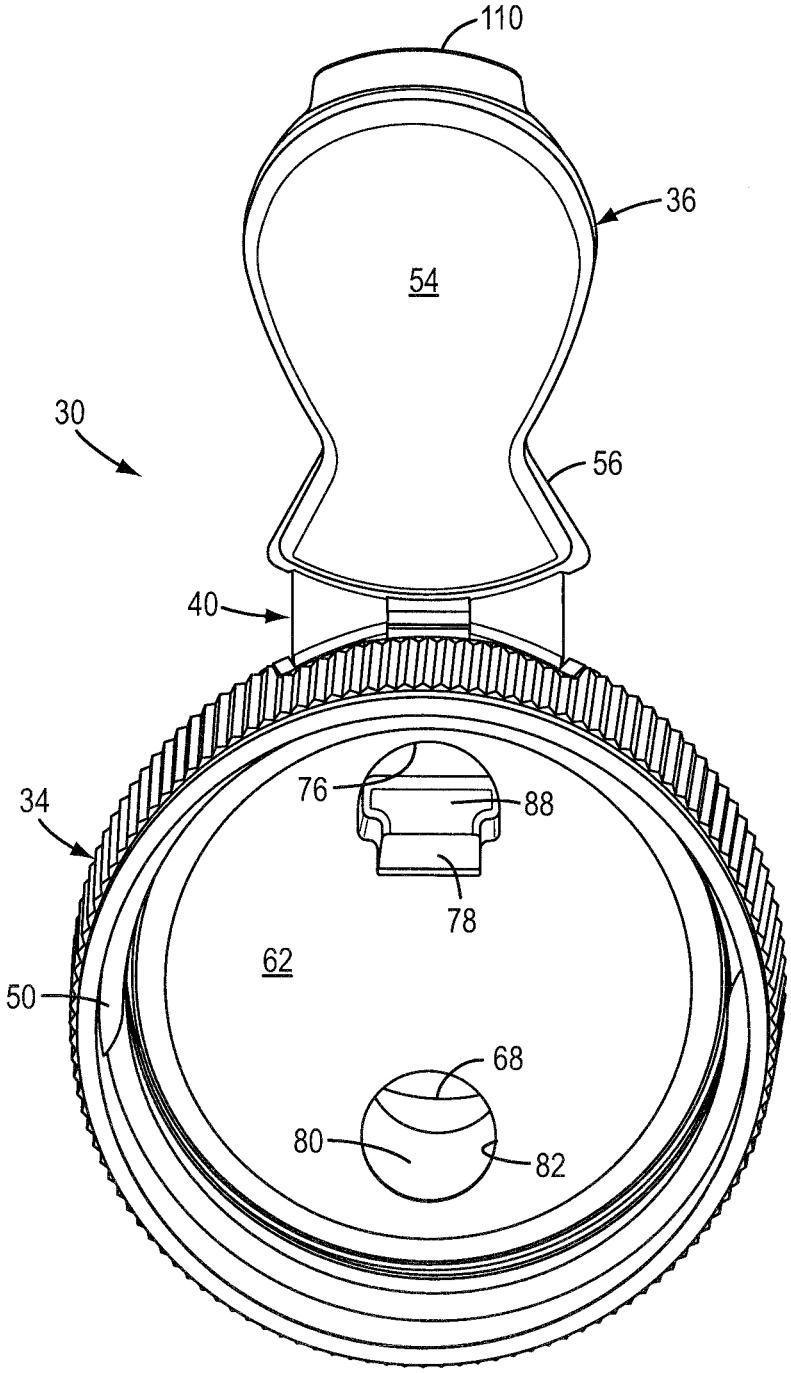
FIG. 17 is an isometric view from below and to the rear of the open closure.

The interior of the closure base 34 may also include special or conventional seal features to provide an enhanced leak-tight seal between the closure base 34 and the container 31. In the illustrated embodiment and as best seen in FIG. 11, the closure body 34 includes such an enhanced seal feature in the form of an annular seal 52 that is engageable with an upper surface of the container surrounding the container opening, with the illustrated seal 52 commonly being referred to as a "crab's claw" type seal. It should be appreciated that any other suitable type of seal feature can be employed depending upon the requirements of each particular application.

As best seen in FIGS. 7-11, the lid 36 has a top cover portion 54 surrounded by a depending peripheral wall or flange 56. The lid top cover portion 54 and flange 56 are joined to the base 34 by the connecting structure 40. In this regard, the connecting structure 40 may be of any suitable conventional design known in the closure art, or may be of any suitable special design. The particular connecting structure 40 in the illustrated embodiments of the closure 30 consists of one type of a conventional snap-action type hinge structure 40. The hinge structure 40 may be conveniently molded from a suitable thermoplastic material to include (1) two spaced-apart diverging elements or membranes 58 that are defined between upper and lower film hinges 59 such that elements 58 connect the lid flange 56 to the base skirt 46, and (2) a central film hinge 60 that connect the lid flange 56 to the base skirt 46.

The above-described snap-action hinge structure 40 permits the lid 36 to be moved between the open and closed positions because the elements 58 and 60 move through a dead center position at which each element 58 and 60 is maximally deformed. On either side of the dead center position, the deformation of the elements 58 and 60 is at least partly reduced, and the lid 36 is thus urged to a stable position at the end of its travel range on that side of the dead center position. Thus, when the lid 36 is in the closed position (FIGS. 1-6 and 1), it is self-maintained in the closed position. On the other hand, when the lid 36 is open (FIGS. 7-10 and 12), it is self-maintained in that position to accommodate dispensing of the contents without having to use one's fingers to hold the lid 36 out of the way.

While a snap-action hinge is preferred, the connecting structure 40 need not be a snap-action hinge depending upon the particular demands of each application. Rather it could instead be some other type of connecting structure such as a simple hinge that lacks a snap action, a simple strap or tether, etc.

The base 34 has a deck wall 62 overlaying the container opening 31, a pouring spout 64 extending along a longitudinal axis 66 from the deck wall 62 to a pouring lip 68 above the deck wall 62, a dispensing port 70 extending through the deck wall 62 and terminating at a location within the pouring spout 64 below the pouring lip 68 to direct product from the container opening to the pouring spout 64, and a vent port 74 spaced laterally from the dispensing port 70 and extending from a first orifice 76 in the deck wall 62 to a second orifice 78 located within the pouring spout 64 before the pouring lip 68. As shown by the arrow A in FIG. 11, the second orifice 78 is oriented to direct any product exiting the second orifice 78 along a flow vector that is nonparallel to the longitudinal axis 66.

With reference to FIGS. 7, 8, 10, 12, 13 and 15-17, in the first illustrated embodiment, the dispensing port 70 includes a cylindrical surface 80 that extends above the deck wall 62 parallel to the axis 66, with the cylindrical surface 80 having a height H above the deck wall 62 that is greater in magnitude than the diameter D of the cylindrical surface 80. For the second embodiment of the closure 30 shown in FIGS. 18-25, the cylindrical surface 80 has a height H above the deck wall 62 that is less than the diameter D of the cylindrical surface 80. For the third embodiment of the closure 30 shown in FIGS. 27-30, the cylindrical surface 80 is eliminated and the dispensing port is defined by an orifice 82 in the deck wall 62, with the orifice 82 of the third embodiment terminating at the deck wall 62 within the pouring spout 64. It should be understood that while the preferred embodiments show the surface 80 and the orifice 82 as having circular cross-sections, in some applications it may be desirable for either or both the surface 80 and the orifice 82 to have non-circular cross-sections, such as, for example, with one or the other or both of the features potentially having oval or triangular or elliptical or polygonal or any other suitable cross-sectional shape.

With reference to FIGS. 7, 8, 10-13 and 15-17 for the first embodiment; FIGS. 18-24 for the second embodiment; and FIGS. 26-30 for the third embodiment; the vent port 74 includes an orifice wall 84 extending above the deck wall 62 within the pouring spout 64. The second orifice 78 is formed in and passes through the orifice wall 84. The vent port 74 further includes a semi-cylindrical surface 86 extending above the deck wall 62 to an upper surface 88 extending from the semi-cylindrical surface 86 to the orifice wall 84 to define a closed flow path between the first and second orifices 76 and 78.

Figure 10:
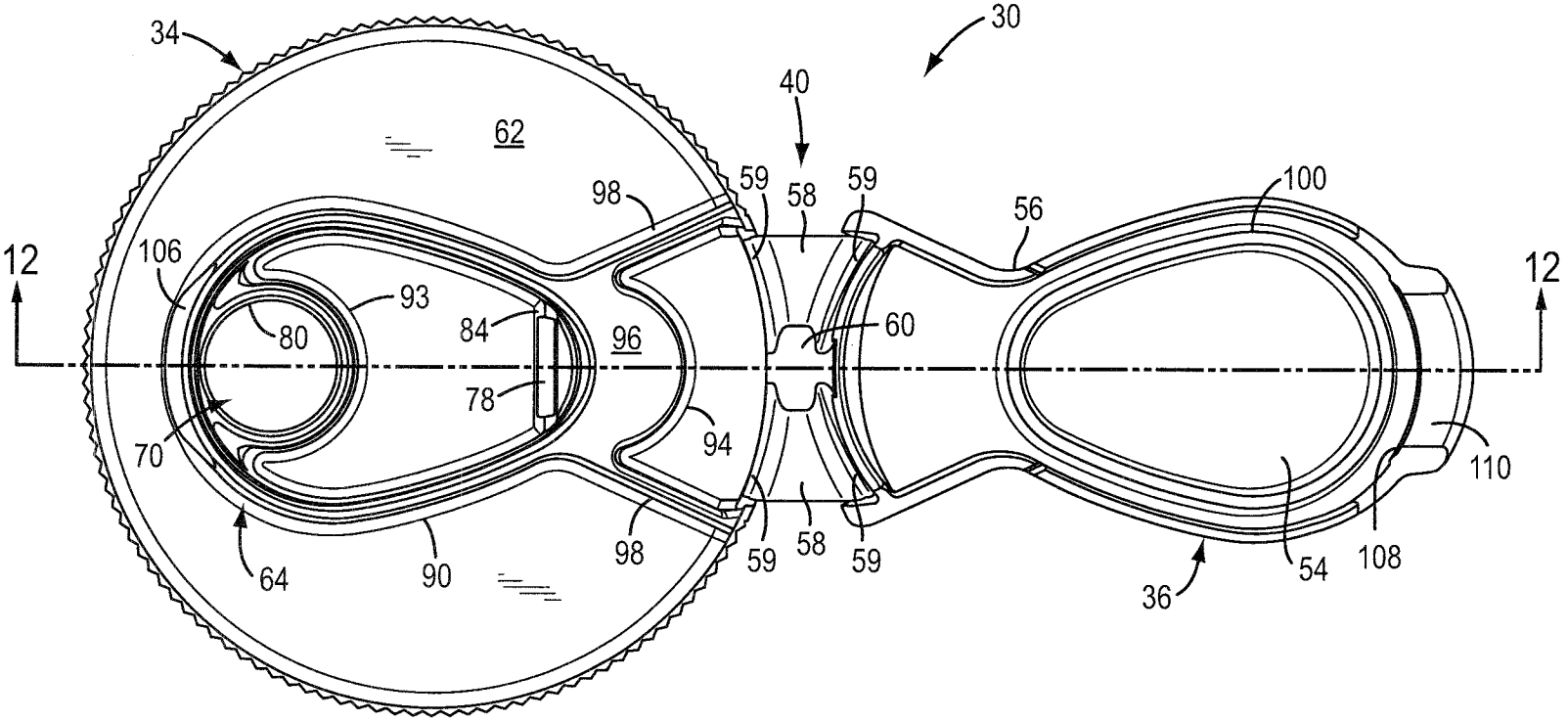
FIGS. 10 and 10A are top plan views of the open closure, with FIG. 10A showing a slightly modified embodiment.
Figure 10A:
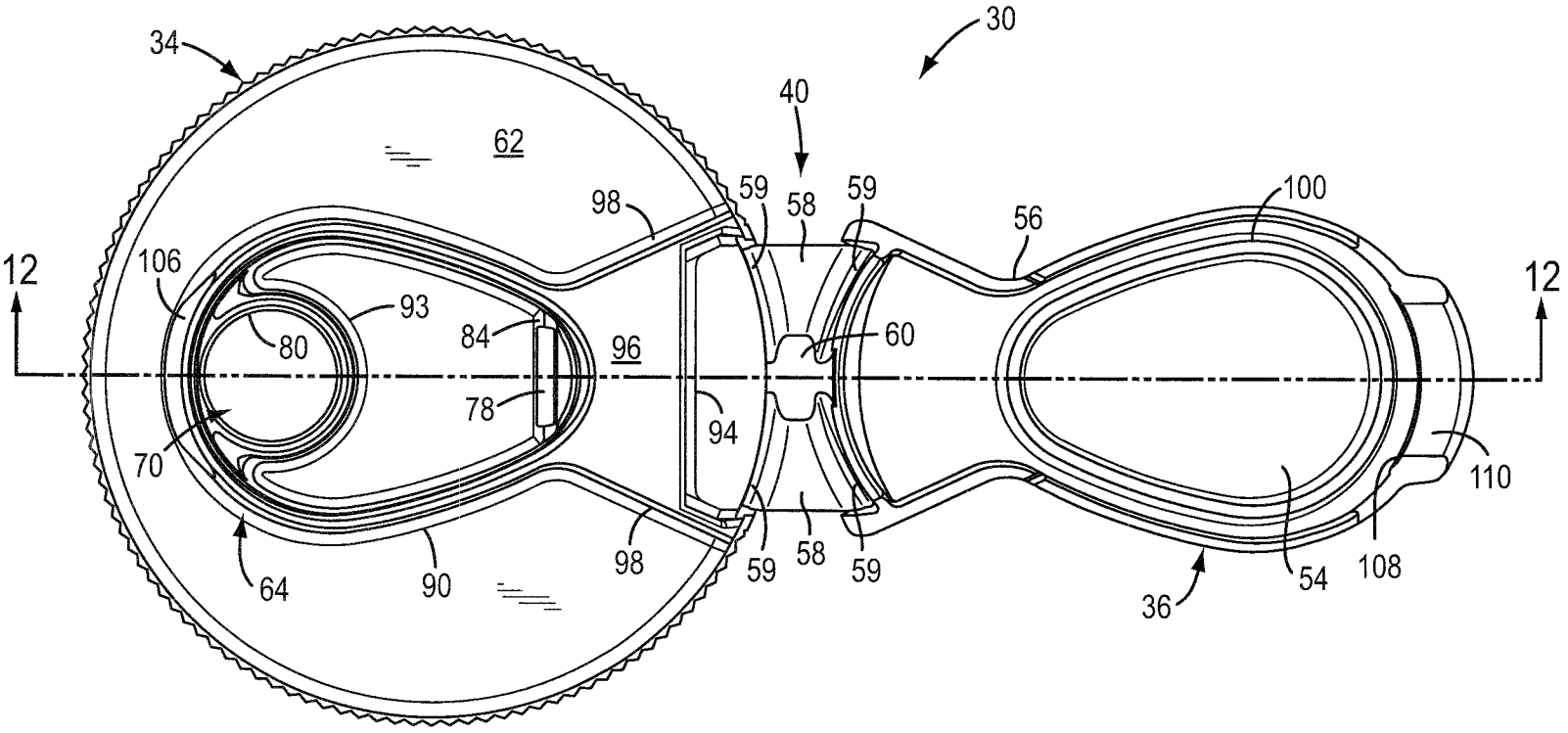
Figure 18:
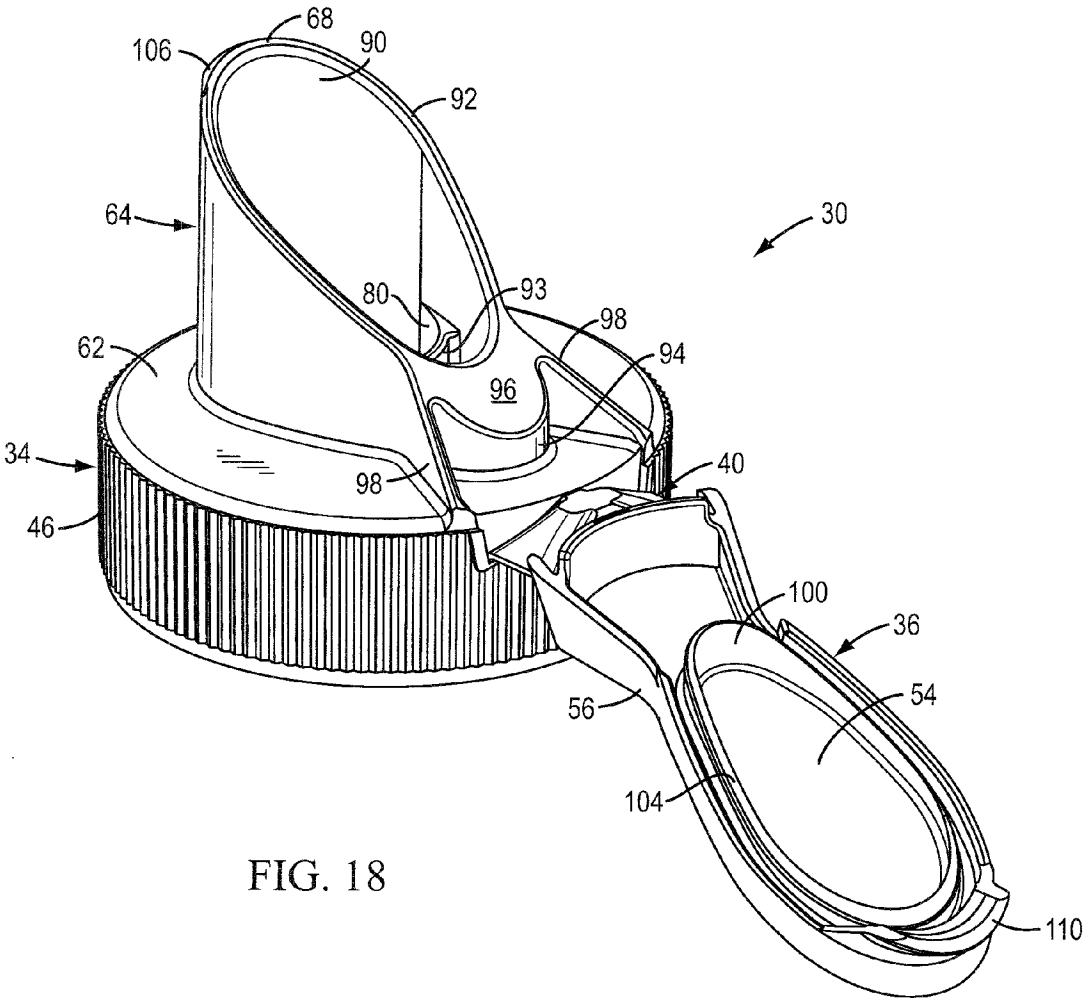
FIG. 18 is an isometric view from above and to left and rear of a second embodiment of the closure in an opened condition.
Figure 19:
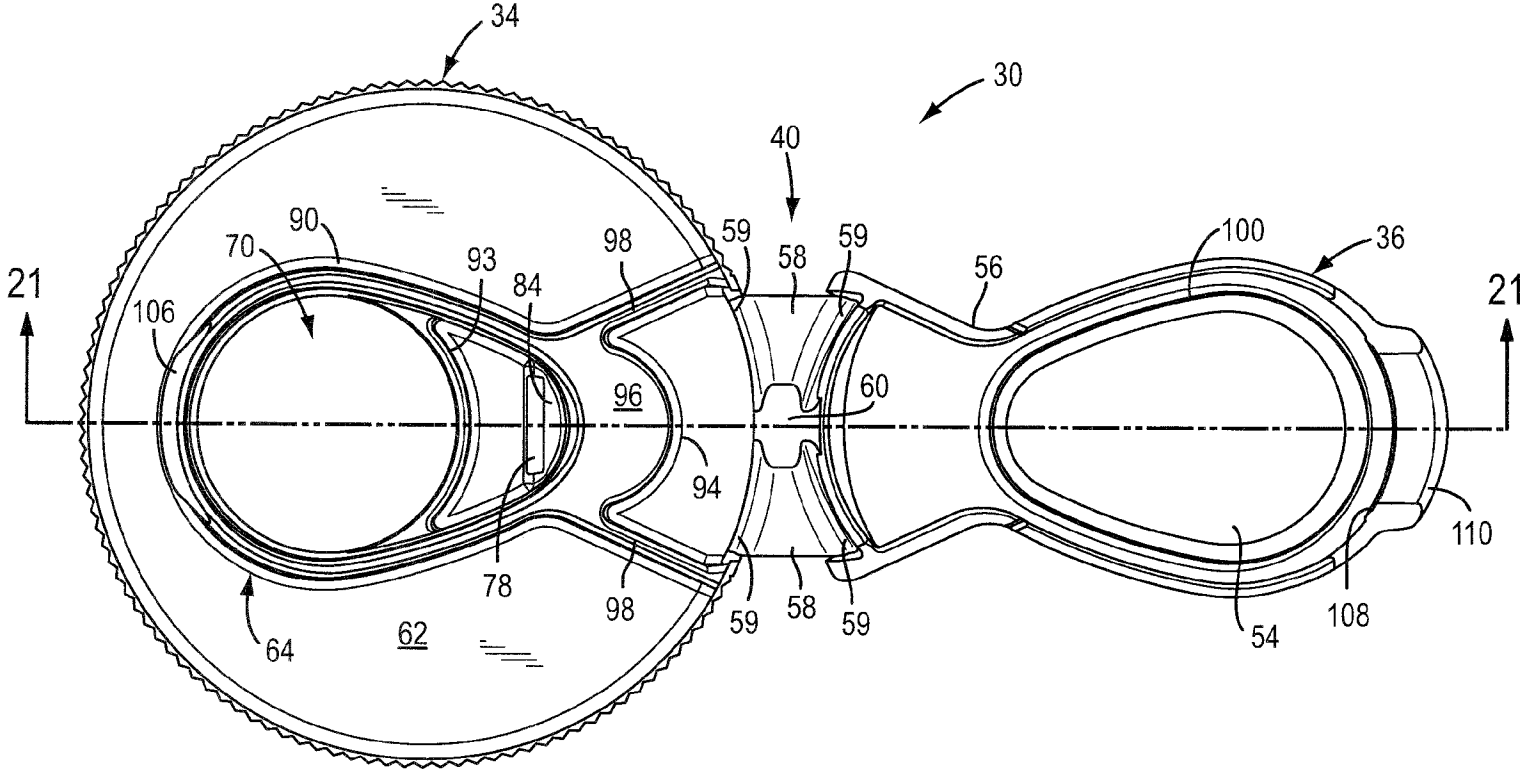
FIG. 19 is a top plan view of the second embodiment of the closure in the opened condition.
Figure 20:
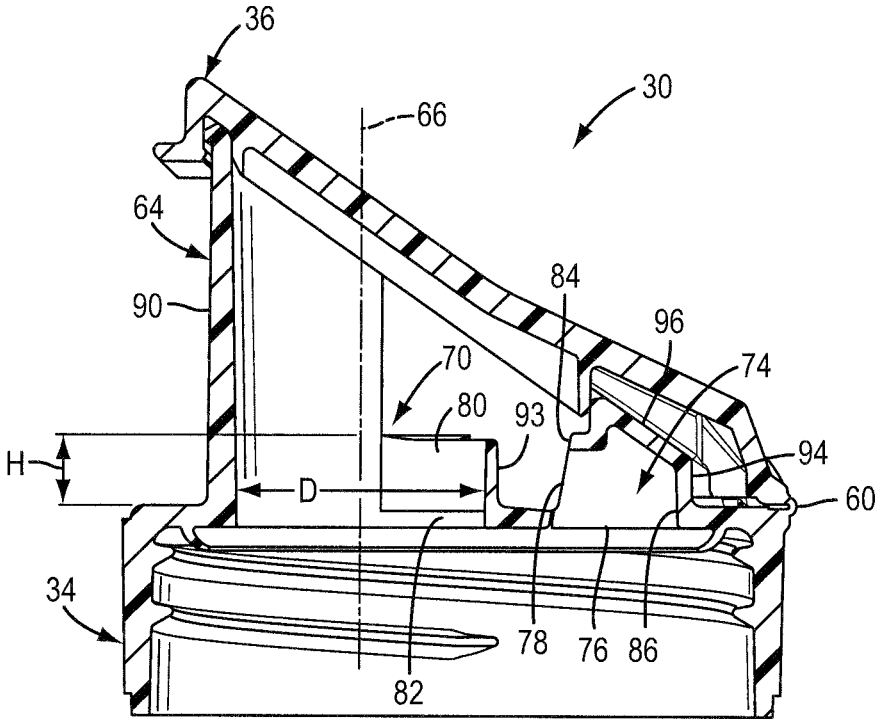
FIG. 20 is a sectional view similar to FIG. 11, but showing the second embodiment of the closure in the closed condition.
Figure 21:
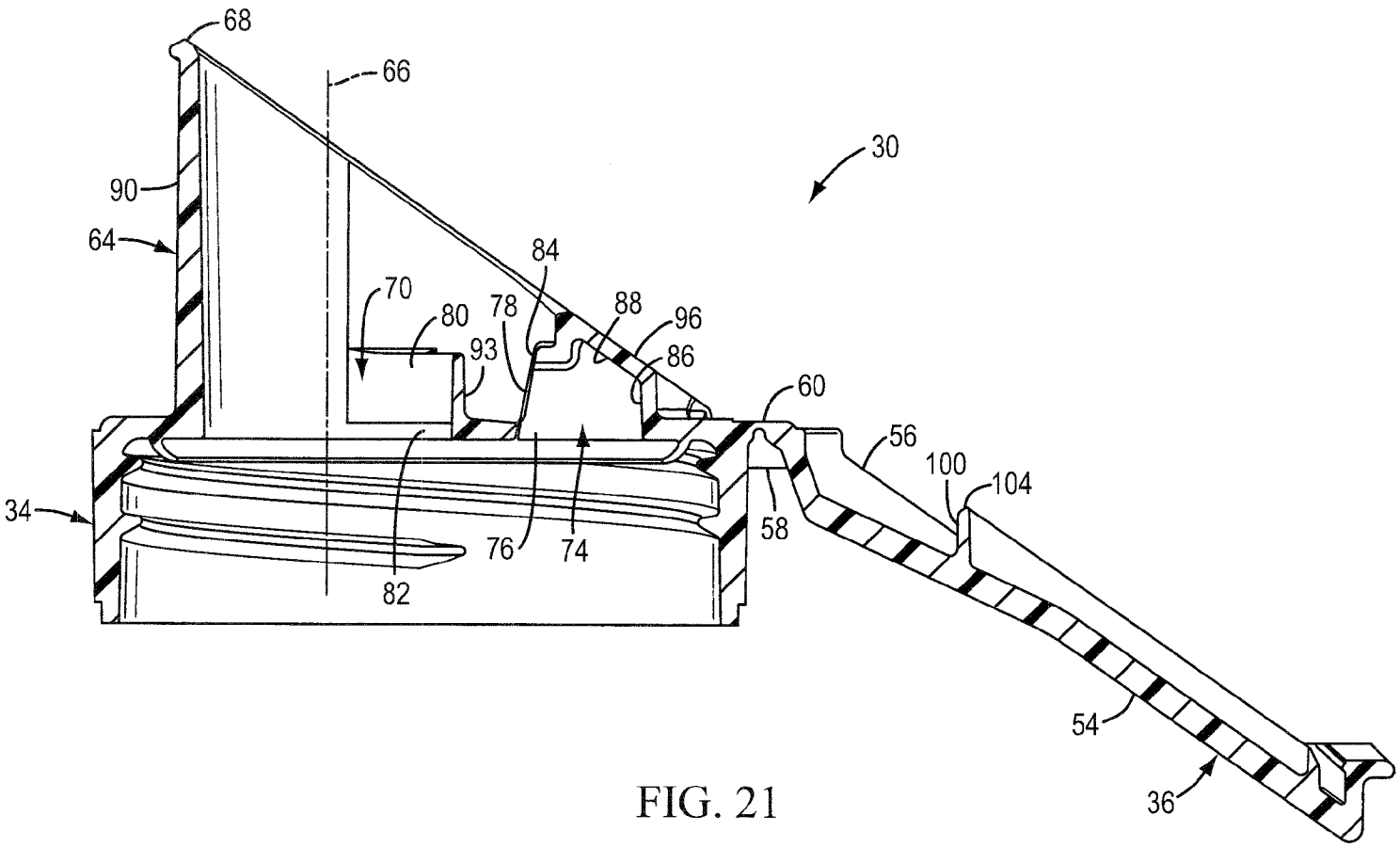
FIG. 21 is a sectional view similar to FIG. 12, but showing the second embodiment of the closure in the opened condition.
Figure 22:
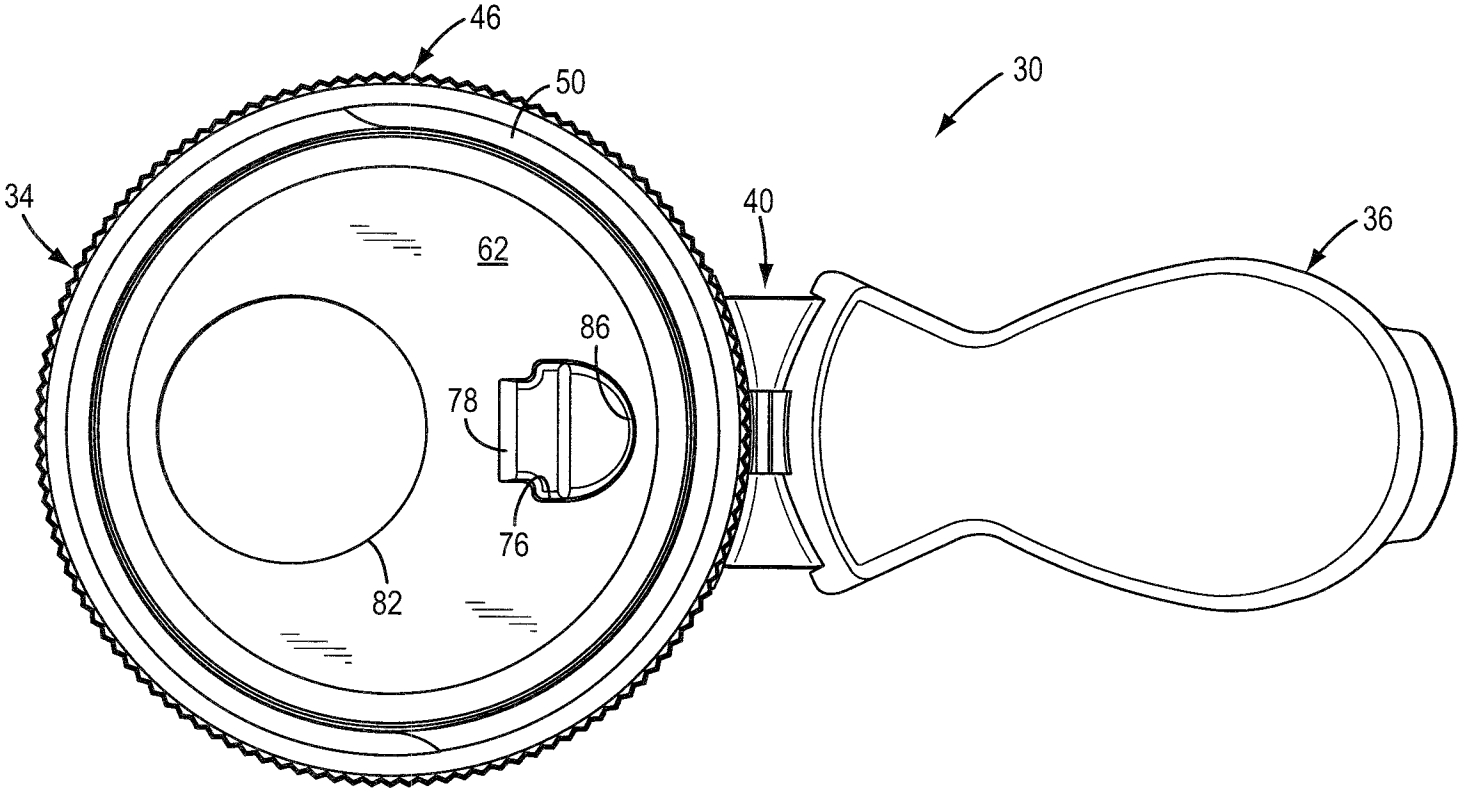
FIG. 22 is a bottom plan view of the second embodiment of the closure.
Figure 23:
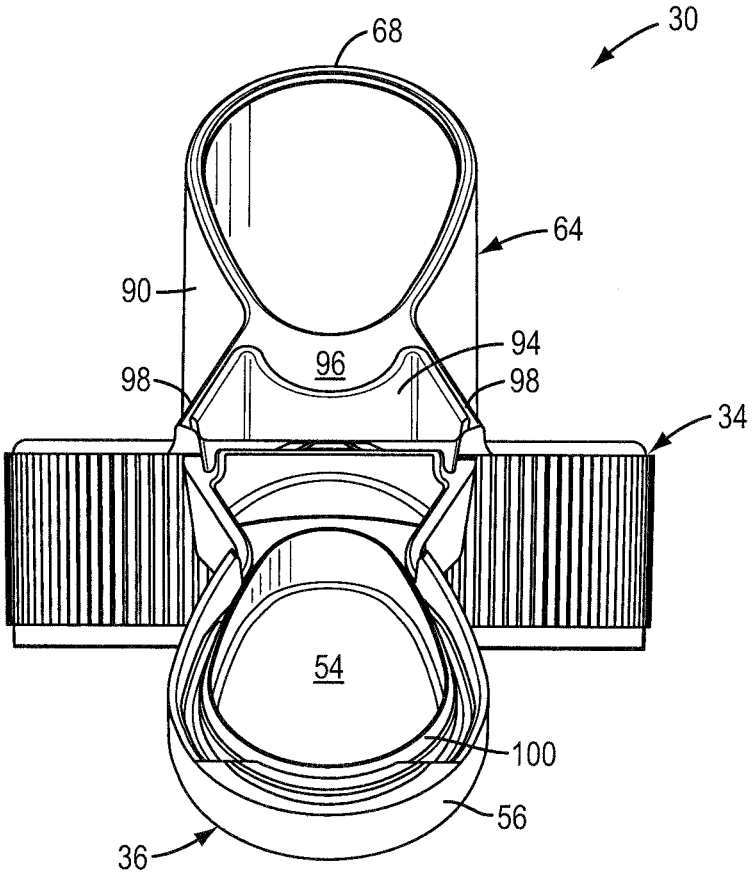
FIG. 23 is a rear elevation view of the second embodiment of the closure in the opened condition.
Figure 24:
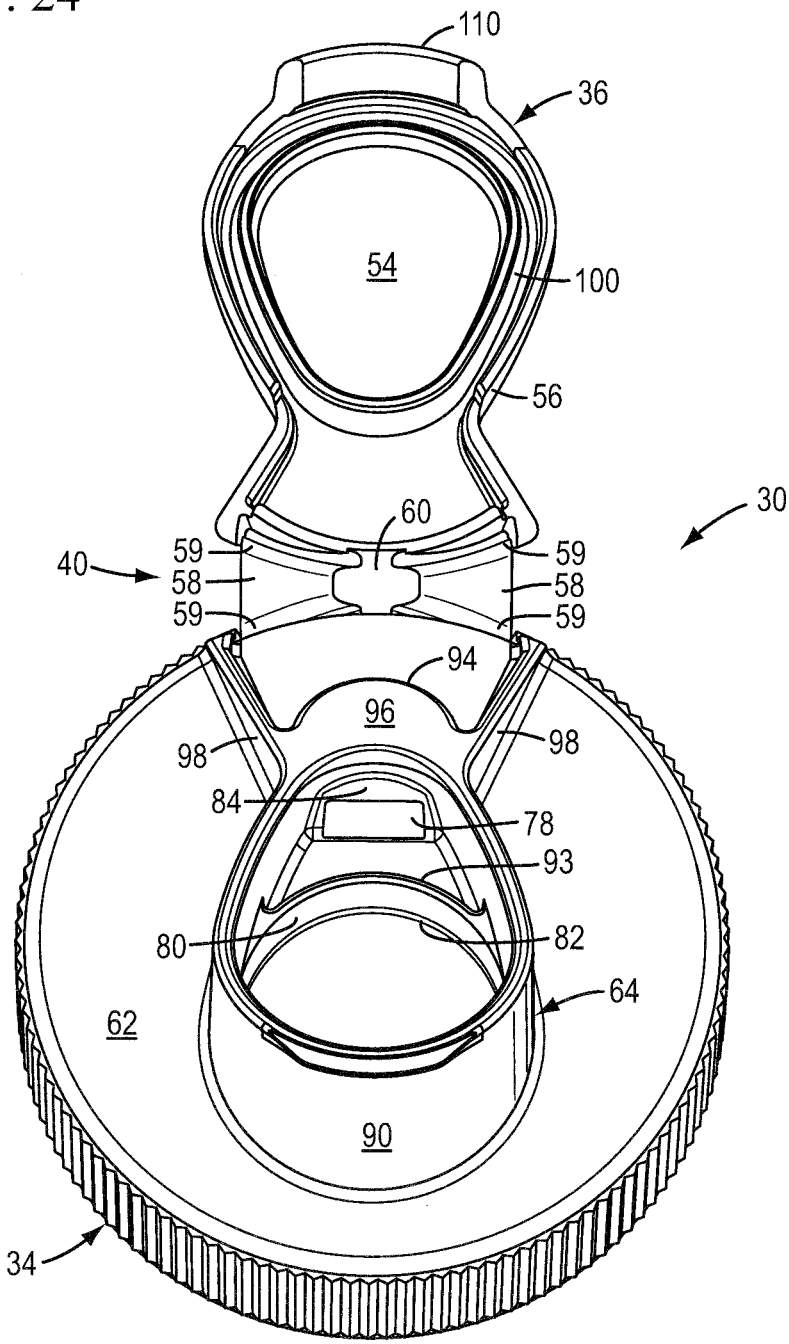
FIG. 24 is an isometric view from above and to the front of the second embodiment of the closure in the opened condition.
Figure 25:
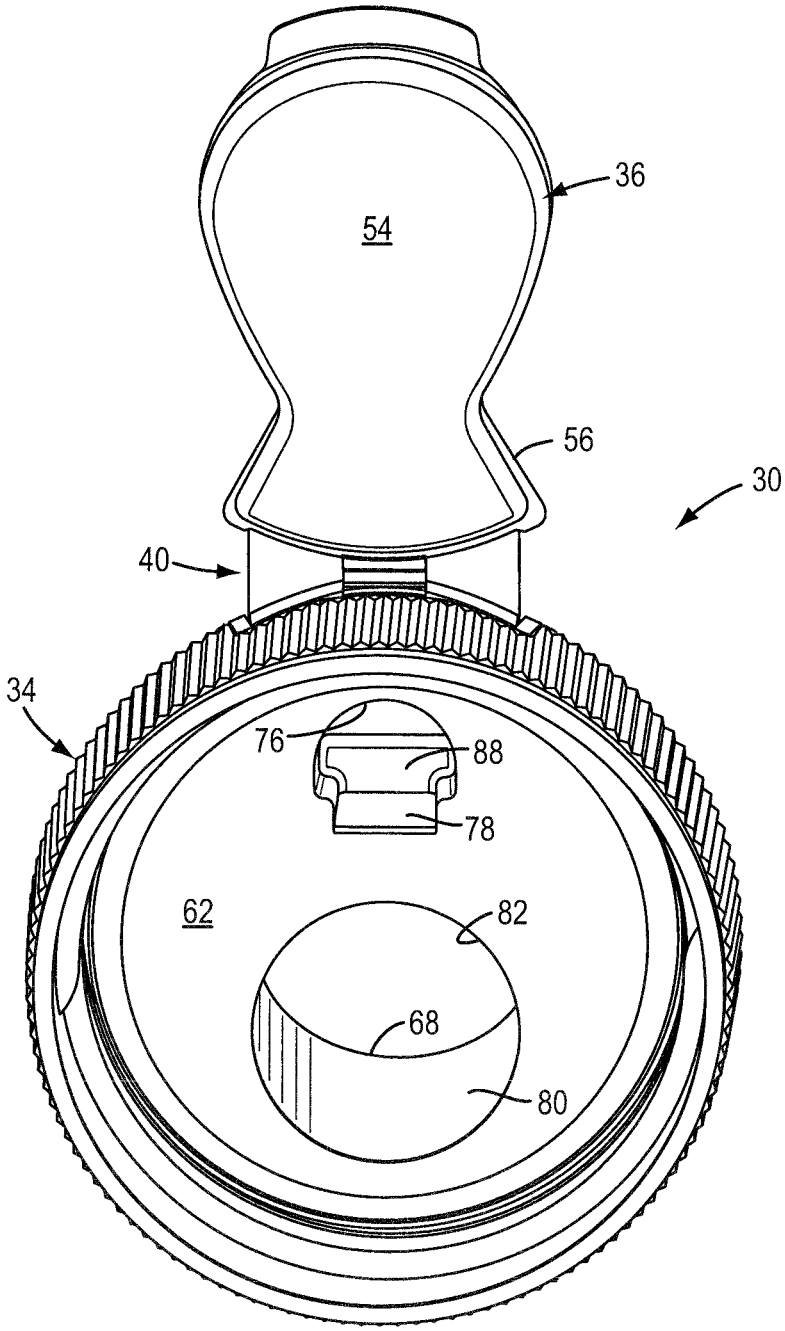
FIG. 25 is an isometric view from below and to the rear of the second embodiment of the closure in the opened condition.
Figure 26:
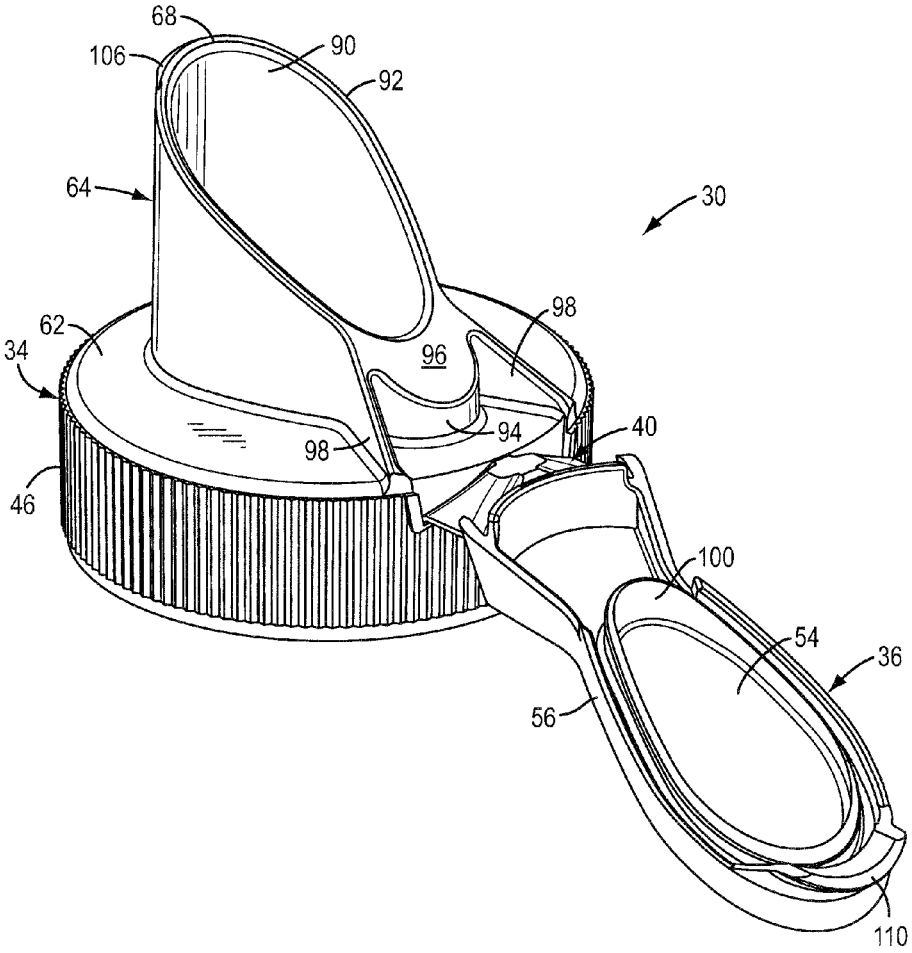
FIG. 26 is an isometric view from above and to the left and rear of a third embodiment of the closure in an opened condition.
Figure 27:
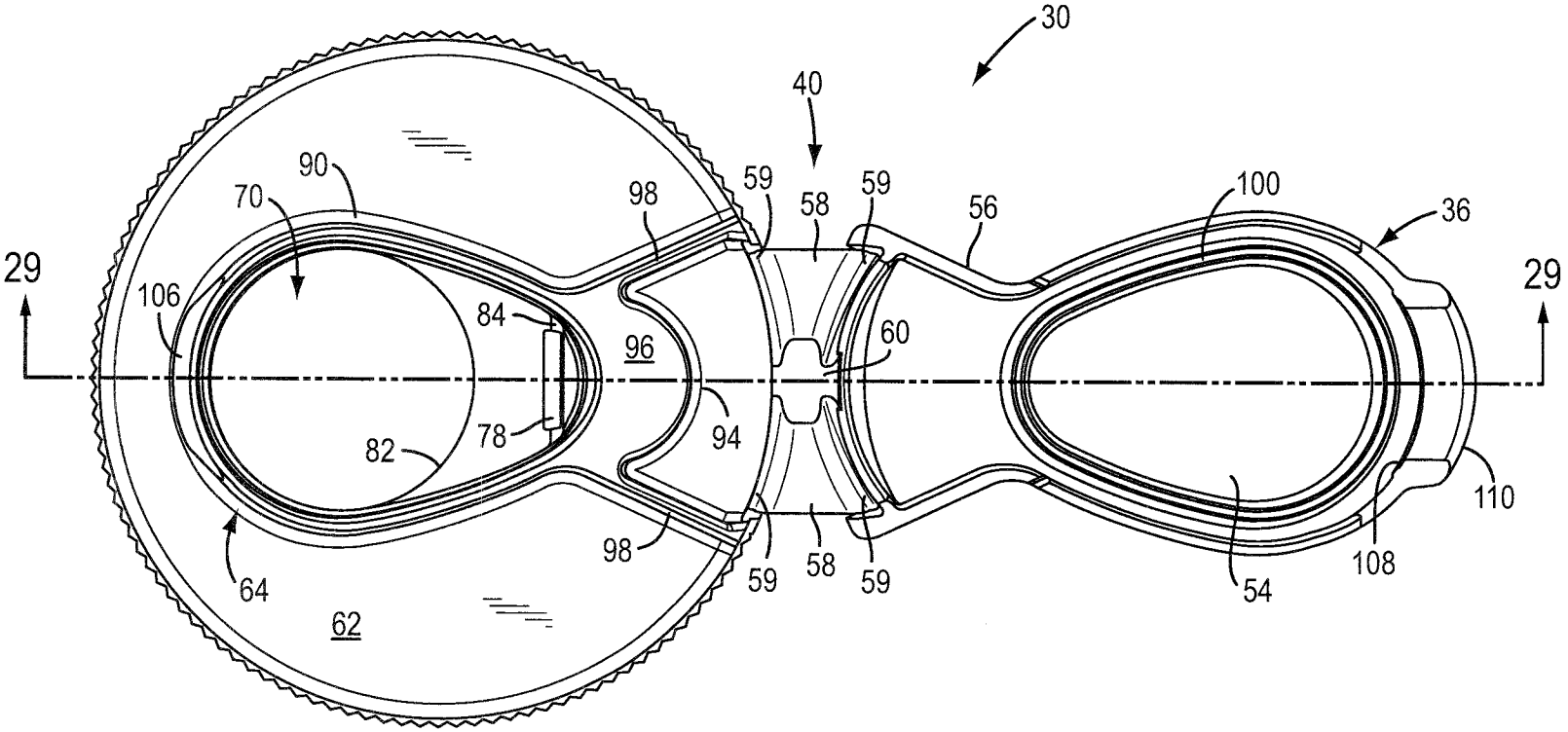
FIG. 27 is a top plan view of the third embodiment of the closure in the opened condition.
Figure 28:
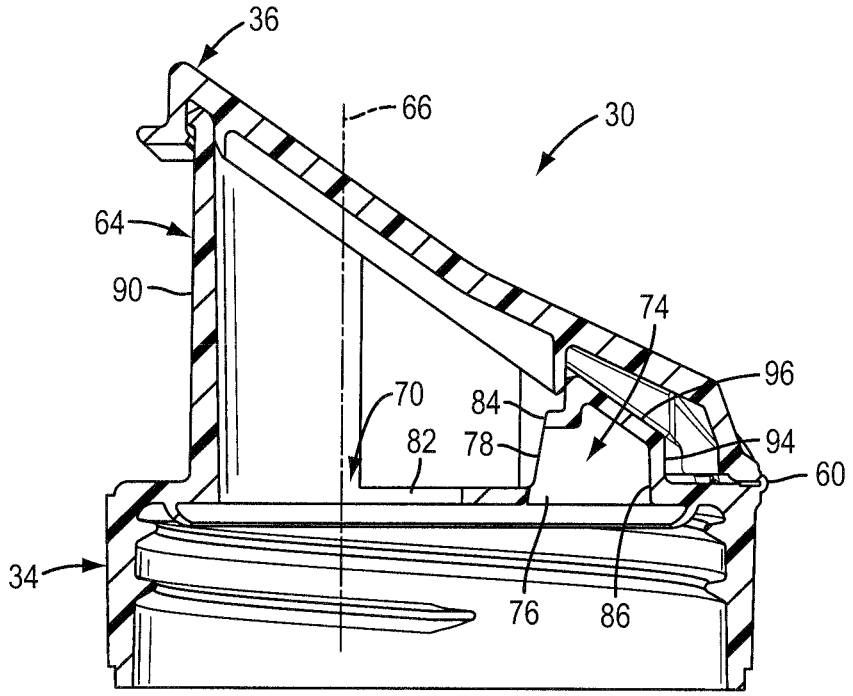
FIG. 28 is a sectional view similar to FIGS. 11 and 20, but showing the third embodiment of the closure in the closed condition.
Figure 29:
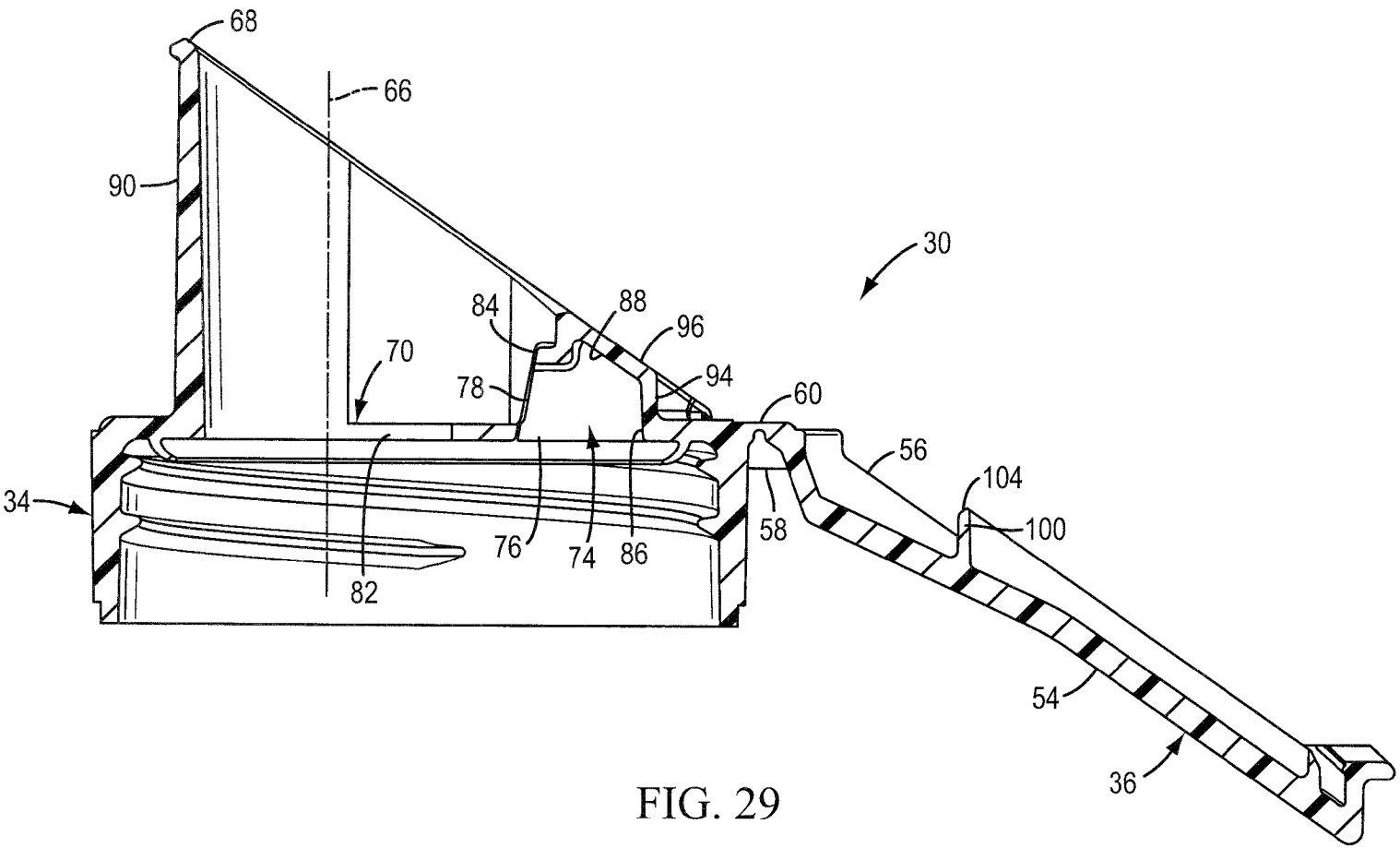
FIG. 29 is a sectional view similar to FIGS. 12 and 21, but showing the third embodiment of the closure in the opened condition.
Figure 30:
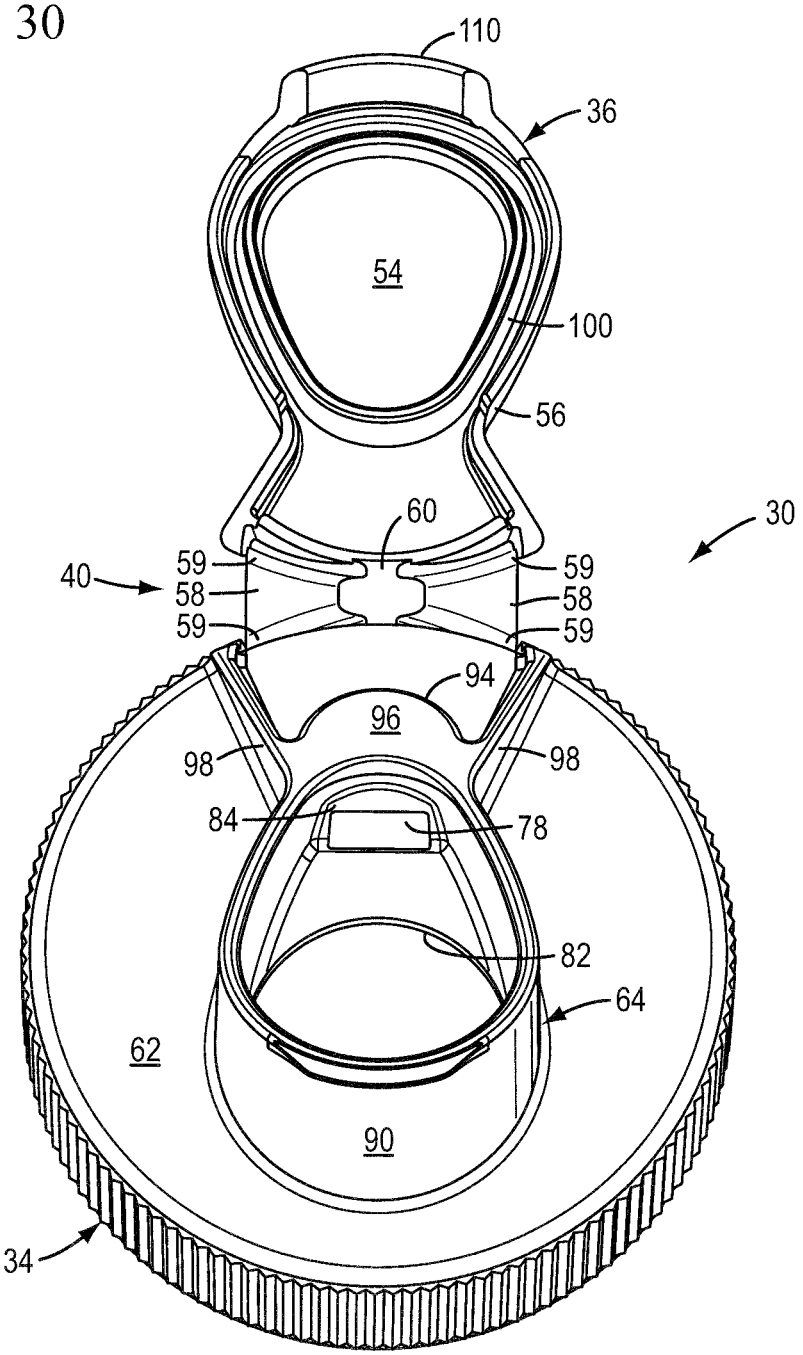
FIG. 30 is an isometric view from the front and above of the third embodiment of the closure.

As best seen in FIGS. 7, 8, 18 and 26, the pouring spout 64 is defined by a spout wall 90 that extends above the deck to a peripheral edge 92 that includes the pouring lip 68. As best seen in FIGS. 8, 10, 11, 12, 15 and 16 for the first embodiment and in FIGS. 18-21 for the second embodiment, the cylindrical surface 80 of the first and second embodiments is defined by a portion of the spout wall 90 in combination with a semi-cylindrical wall 93 that extends above the deck wall 62 and is blended to the spout wall 90 within the pouring spout 64. As best seen in FIGS. 8, 10, 11, 12, 18-21 and 26-29, the semi-cylindrical surface 86 is defined by a semi-cylindrical wall 94 extending above the deck wall 62 and blended to the spout wall 90, and the upper surface 88 is defined by an angled wall 96 extending from the semi-cylindrical wall 94 to the peripheral edge 92 of the spout wall 90. It should be appreciated that while the preferred embodiments show the surface 86 and the wall 94 as being semi-cylindrical, in some applications in may be desirable for other geometries to be used. For example, as shown in FIG. 10A, the surface 86 and the wall 94 can be planer. As best seen in FIGS. 8, 18 and 26, flange walls 98 extend from the skirt 46 to the walls 90 and 94 and are blended therewith.

Advantageously, the illustrated geometries/configurations of the pouring spout 64, the dispensing port 70, and the vent port 74 allow the closure 30 to be formed by a straight pull of opposing mold tools. In this regard, it should be appreciated that many of the features of the closure 30 preferably taper slightly so as to provide a molding draft angle to facilitate pulling of the mold tools. These features include, for example, the cylindrical surface 80, the orifice wall 84, the semi-cylindrical surface 86, the semi-cylindrical wall 93, and the semi-cylindrical wall 94. Accordingly, it should be understood that surfaces that have previously been described as cylindrical and/or semi-cylindrical are in actuality substantially cylindrical or substantially semi-cylindrical in view of the molding draft angle, and that as used herein the terms cylindrical and semi-cylindrical include geometries that incorporate a draft angle as shown in the figures.

Preferably, as best seen in FIGS. 8, 11, 12, 18, 20, 21, 26, 28 and 29, a sealing spud 100 is provided on the lid 36 and is sized and shaped to engage an inner surface 102 of the peripheral edge 92 to seal the pouring spout 64, with the spud 100 preferably having a chamfered edge 104 to assist engagement of the spud 100 with the surface 102. While the spud 100 is preferred, it should be understood that other suitable seal configuration, many of which are know, may be desirable depending upon the requirements of any particular application.

The closure 30 of the illustrated embodiments also includes a latch bead 106 on the spout wall 90 and a cooperating latch bead 108 on the lid 36 that engage so as to further resist movement of the lid 36 from the closed position. In this regard the lid 36 further includes a thumb or finger lift surface 110 that can be pushed by a user so as to disengage the beads 106 and 108 and move the lid 36 from the closed position.

It should be appreciated that the location of the second orifice 78 within the pour spout 64 allows any "spurting" of product from the vent port 74 to be combined with the desired flow of product from the dispensing port 70. It should further be appreciated that the lateral spacing of the venting port 74 from the dispensing port 70 on opposite sides of the opening 32 creates a separation that allows passage of air through the vent port 74 without interrupting the desired flow of product from the dispensing port 70. Further, it should be appreciated that the orientation of the second orifice 78 directs any "spurting" or "surge" of product from the vent port 74 directly toward the dispensing port 70 so as to be combined with the desired flow therefrom. It should also be appreciated that the location of both the ports 70 and 74 within the pouring spout 64 below the edge 92 allows for a single seal, such as the spud seal 100, to engage the pour spout 64 and prevent leakage of product from the closure 30 via the ports 70 and 74.

It will be readily apparent from the foregoing detailed description of the invention and from the illustrations thereof that numerous variations and modifications may be effected without departing from the true spirit and scope of the novel concepts or principles of this invention.

What is claimed is:

1. A closure for an opening of a container having a container interior for storing a product, the closure comprising:

a base that is either (A) separate from said container for being attached to said container, or (B) a structure formed as a unitary portion of said container, the base having a deck wall overlaying the opening, a pouring spout extending along a longitudinal axis from the deck wall to a pouring lip above the deck wall, a dispensing port extending through the deck wall and terminating at a location within the pouring spout below the pouring lip to direct product from the opening to the pouring spout, and a vent port spaced laterally from the dispensing port and extending from a first orifice in the deck wall to a second orifice located within the pouring spout below the pouring lip, the second orifice oriented to direct any product exiting the second orifice along a flow vector that is non-parallel to the longitudinal axis.

2. The closure of claim 1 wherein the dispensing port is defined by an orifice in the deck wall.

3. The closure of claim 1 wherein the orifice terminates at the deck wall within the pouring spout.

4. The closure of claim 1 wherein the dispensing port extends parallel to the longitudinal axis.

5. A closure for an opening of a container having a container interior for storing a product, the closure comprising:

a base that is either (A) separate from said container for being attached to said container, or (B) a structure formed as a unitary portion of said container, the base having a deck wall overlaying the opening, a pouring spout extending along a longitudinal axis from the deck wall to a pouring lip above the deck wall, a dispensing port extending through the deck wall and terminating at a location within the pouring spout below the pouring lip to direct product from the opening to the pouring spout, and a vent port spaced laterally from the dispensing port and extending from a first orifice in the deck wall to a second orifice located within the pouring spout below the pouring lip, the second orifice oriented to direct any product exiting the second orifice along a flow vector that is non-parallel to the longitudinal axis;

wherein the dispensing port extends parallel to the longitudinal axis; and wherein the dispensing port comprises a surface extending above the deck wall, the surface at any point along a height of the surface above the deck wall having a circular cross-section.

6. The closure of claim 5 wherein the surface has a height H above the deck wall that is less than a diameter D of the smallest circular cross-section along the height H.

7. The closure of claim 5 wherein the surface has a height H above the deck wall that is greater than a diameter D of the smallest circular cross-section along the height H.

8. A closure for an opening of a container having a container interior for storing a product, the closure comprising:

a base that is either (A) separate from said container for being attached to said container, or (B) a structure formed as a unitary portion of said container, the base having a deck wall overlaying the opening, a pouring spout extending along a longitudinal axis from the deck wall to a pouring lip above the deck wall, a dispensing port extending through the deck wall and terminating at a location within the pouring spout below the pouring lip to direct product from the opening to the pouring spout, and a vent port spaced laterally from the dispensing port and extending from a first orifice in the deck wall to a second orifice located within the pouring spout below the pouring lip, the second orifice oriented to direct any product exiting the second orifice along a flow vector that is nonparallel to the longitudinal axis; and wherein the vent port comprises an orifice wall extending above the deck wall within the pouring spout and the second orifice passes through the orifice wall.

9. The closure of claim 8 wherein the vent port further comprises a surface extending above the deck wall, and an upper surface extending from the surface to the orifice wall to define a closed flow path between the first and second orifices.

10. The closure of claim 1 further comprising a lid connected to the base for movement between a closed position occluding the pouring spout and an open position spaced from the pouring spout.

11. A closure for an opening of a container having a container interior for storing a product, the closure comprising:

a base that is either (A) separate from said container for being attached to said container, or (B) a structure formed as a unitary portion of said container, the base having a deck wall overlaying the opening, a pouring spout extending along a longitudinal axis from the deck wall to a pouring lip above the deck wall, a dispensing port extending through the deck wall and terminating at a location within the pouring spout below the pouring lip to direct product from the opening to the pouring, spout, and a vent port spaced laterally from the dispensing port and extending from a first orifice in the deck wall to a second orifice located within the pouring spout below the pouring lip, the second orifice oriented to direct any product exiting the second orifice along a flow vector that is non-parallel to the longitudinal axis;

further comprising a lid connected to the base for movement between a closed position occluding the pouring spout and an open position spaced from the pouring spout; and wherein the pouring spout is defined by a spout wall extending above the deck wall and terminating at a peripheral edge that includes the pouring hp, and the lid comprises a sealing spud sized to engage an inner surface of the peripheral edge.

12. The closure of claim 10 wherein the lid is connected to the base by a snap-action type hinge that resists movement of the lid from the open position.

13. The closure of claim 1 wherein the geometries of the pouring spout, the dispensing port, and the vent port are arranged to allow the closure to be formed by a straight pull of opposing mold tools.

14. The closure of claim 1 wherein the base further comprises a peripheral skirt extending below the deck wall from a periphery of the deck wall.

* * * * *